United States Patent [19]

Richards et al.

[11] 4,100,842

[45] Jul. 18, 1978

[54] APPARATUS FOR FORMING A CONTAINER

[75] Inventors: Frank P. Richards, Prairie Village, Kans.; Raymond C. Taylor, Grand View; Jerry W. Young, Weston, both of Mo.; Silvio T. Farfaglia, Fulton, N.Y.

[73] Assignee: Phillips Petroleum Company, Bartlesville, Okla.

[21] Appl. No.: 798,197

[22] Filed: May 18, 1977

[51] Int. Cl.[2] ..... B31B 17/02

[52] U.S. Cl. ..... 93/39 C; 93/39.3; 93/36.5 R; 214/8.5 SS; 214/8.5 K; 271/117

[58] Field of Search ..... 93/39.3, 36.5 R, 39 C, 93/39.2; 214/8.5 SS, 8.5 K; 271/10, 117, 118

[56] References Cited

U.S. PATENT DOCUMENTS

| | | | |
|---|---|---|---|
| 2,703,514 | 3/1955 | Thiem | 93/36.5 R X |
| 3,065,677 | 11/1962 | Loeser | 93/36.5 R |
| 3,981,494 | 9/1976 | Feinstein, Jr. et al. | 271/117 X |
| 3,990,353 | 11/1976 | Richards et al. | 93/39.3 X |

*Primary Examiner*—Roy Lake
*Assistant Examiner*—Paul A. Bell

[57] ABSTRACT

An apparatus for forming a container is provided wherein the container is comprised of a side wall having a top bead and also a bottom member secured to the side wall with the side wall being formed from a blank which is wrapped with convolute form having side marginal portions overlapped and secured together. The apparatus includes means for forming the bottom member from a bottom member blank with the formed bottom member being carried by conveying means to various stations of the apparatus. A side wall feeder feeds side wall blanks through a side wall heater and to the conveying means for conveying thereby. A side wall wrapper is provided to wrap the side wall blank in convolute form about a mandrel and bottom member and secure overlapping marginal portions. A heater is provided to heat a bottom portion of the side wall blank and the bottom member so that same can be secured together during a container bottom forming operation by a bottom former which rolls a bottom portion of the side wall blank in overlapping relation to a skirt on the bottom member and then a bottom crimper is provided for finishing the bottom. The container in this form is then transferred to another conveying means which is operable to convey the partially completed container to a bead-forming means for forming a bead on the upper edge of the container. After this, the container is complete and ready for use.

8 Claims, 29 Drawing Figures

APPARATUS FOR FORMING A CONTAINER

Many apparatuses are known in the art for manufacturing containers, particularly containers formed from paperboard or coated paperboard or the like. The present invention provides an improved such apparatus which is adapted for high speed operation as, for example, at 90 containers per minute. The apparatus of the present invention is particularly well adapted for forming tapered containers but can also be used with slight modification to form cylindrical containers. The apparatus includes improved bottom forming means, side wall feeding means, side wall wrapping means, and bead forming means which are the areas in which most problems are encountered in currently available container-forming apparatuses.

For example, in the formation of tapered side wall containers a problem has been encountered in formation of a bottom member and inserting same into a formed side wall with the problem becoming increasingly difficult as the degree of taper of the side wall increases. Several methods and apparatuses have been devised to attempt to overcome this problem and the present apparatus provides an alternative means for solving this problem.

The apparatus also includes an improved side wall feeding mechanism which preferably is of the top feed type which does not require shutting down of the apparatus for filling of the magazine as is normally encountered in the top feed type feeding mechanisms.

In the formation of a convoluted side wall type container a side wall wrapping mechanism is provided which will effect overlapping of side marginal portions of the side wall blank so that same can be secured together in the overlapping margins. The present invention provides a side wall wrapping mechanism which not only consistently produces overlapped side marginal portions but is also quiet in operation and has a minimum of play or slack in the various moving portions.

The formation of beads on the top of a partially completed container is of importance because the bead must be accurately formed so as to insure a good fit with a lid which is to be placed thereon. Many apparatuses are known in the art for forming the bead but result in improperly or incompletely formed beads which result in the formation of a scrap part with the attendant cost problems. The bead former of the present invention provides consistent high quality beads or rolled rims with a resulting decrease in the scrap rate.

The principal objects and advantages of the present are: to provide an apparatus for forming containers at high speeds with a minimum of scrap; to provide such an apparatus with improved operating portions, e.g., a bottom former, a blank feeder, a side wall wrapper and a bead former; to provide such an apparatus which is simple in operation and construction requiring a minimum of maintenance and which is inexpensive to construct; and to provide such an apparatus which is well adapted for its intended use.

Other objects and advantages of the present invention will become apparent from the following detailed description taken in connection with the accompanying drawings wherein are set forth by way of illustration and example certain embodiments of the present invention.

FIG . 6 is an enlarged fragmentary sectional view of a die and plunger arrangement used to form a bottom member from a blank showing the bottom member in one stage of formation.

Figure 6:
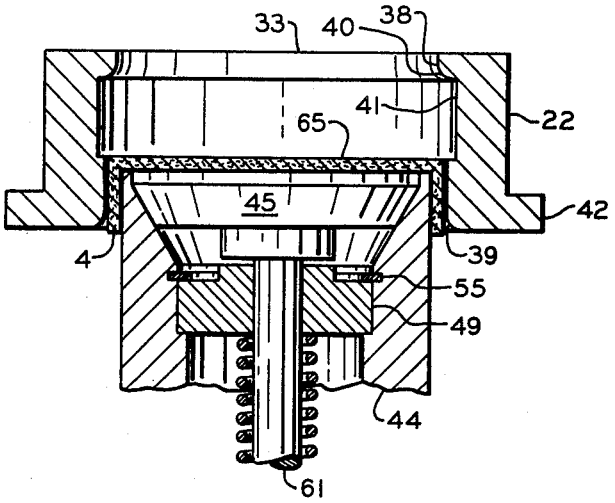
Figure 7:
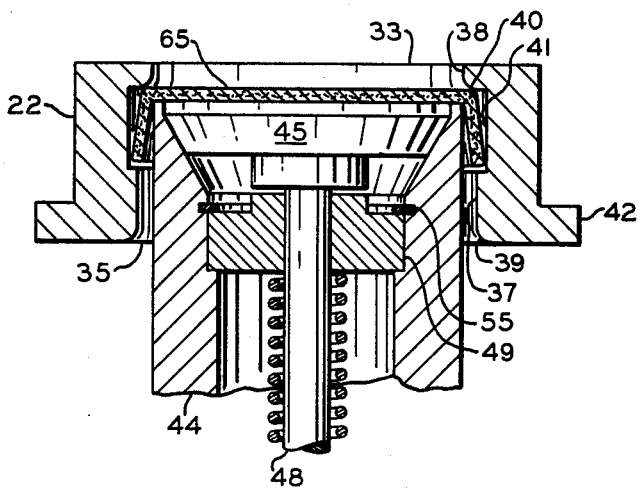

FIG. 7 is a view similar to FIG. 6 showing a second stage of formation of the bottom member.

Figure 8:
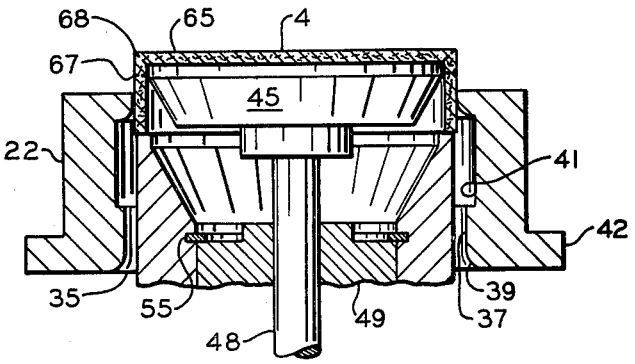

FIG. 8 is a view similar to FIG. 6 showing bottom member in a third stage of formation.

Figure 9:
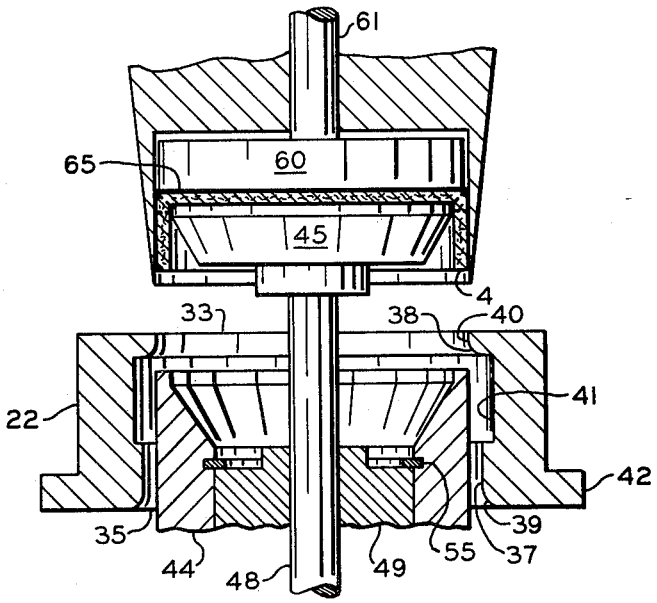

FIG. 9 is a view similar to FIG. 6 showing a formed bottom member positioned in a mandrel after forming.

Figure 10:
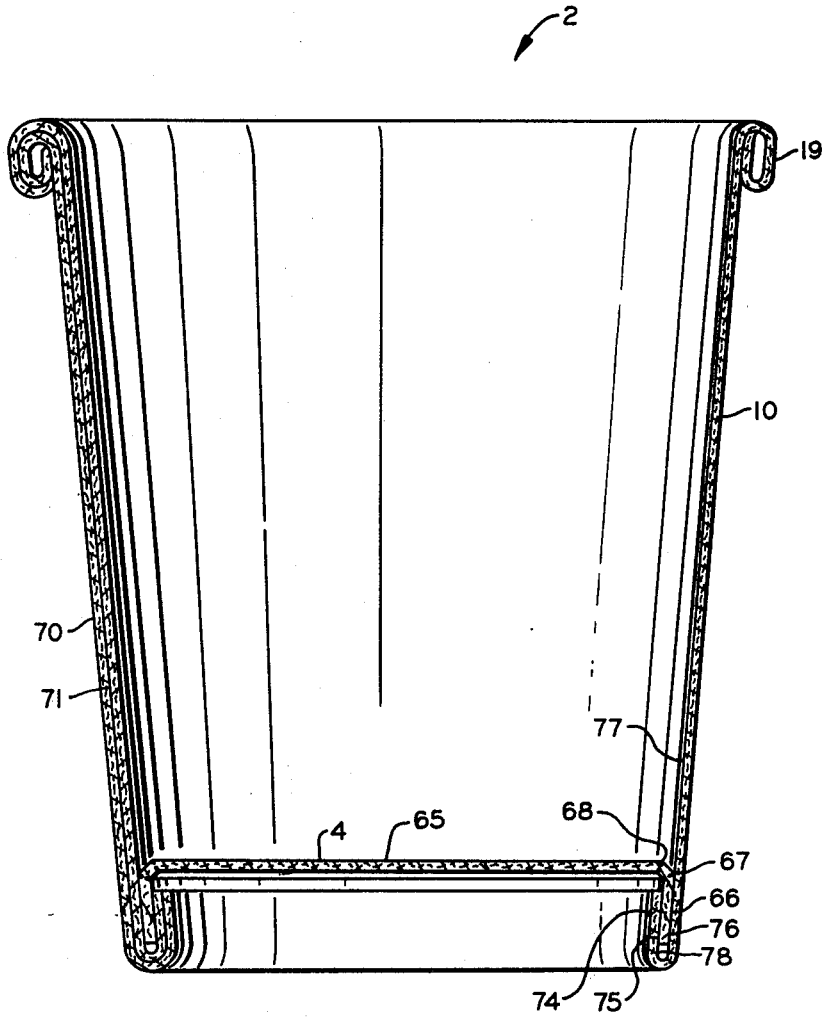

FIG. 10 is an enlarged sectional view of a container formed by the container forming apparatus.

Figure 11:
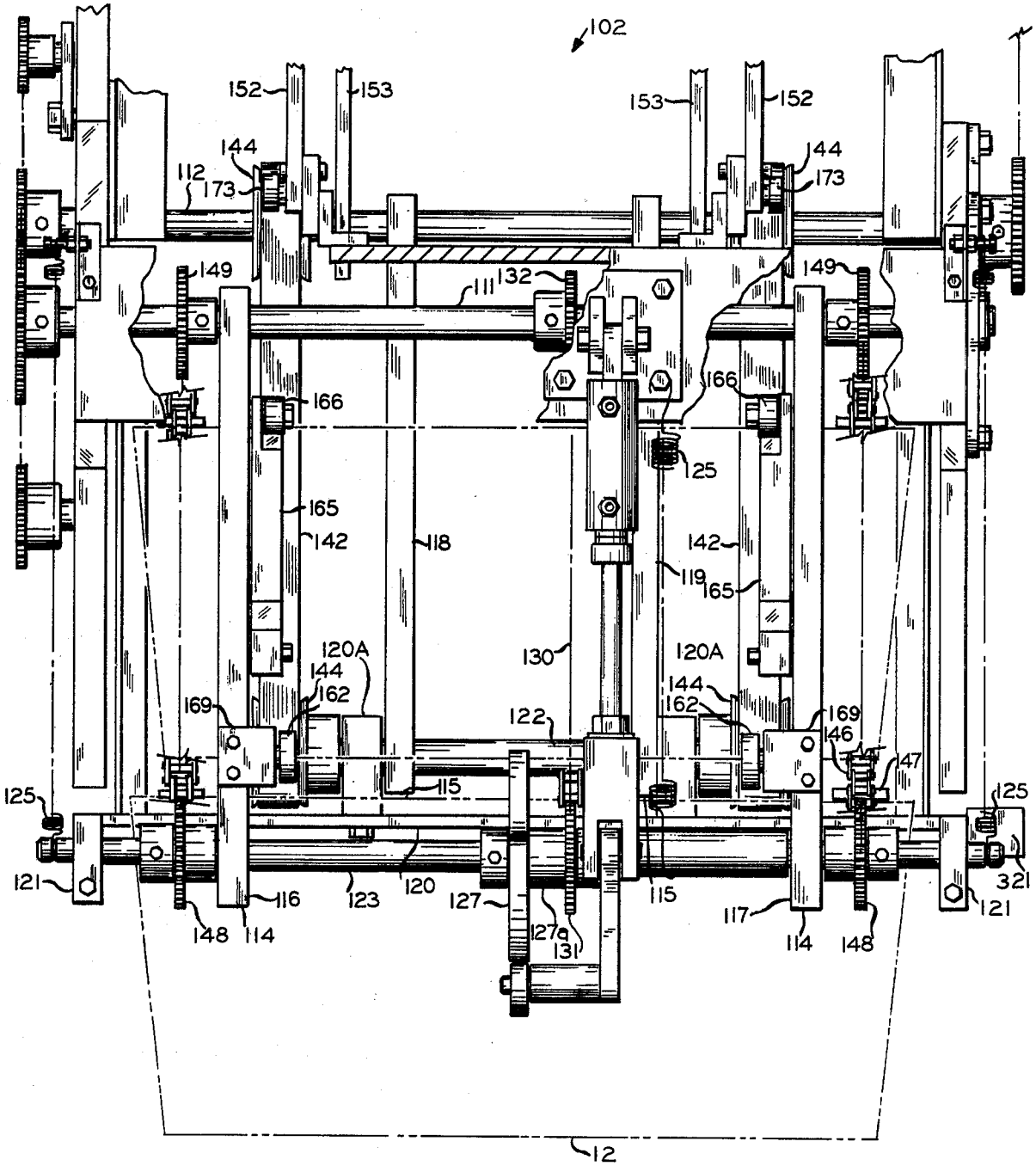

FIG. 11 is a fragmentary plan view of a portion of a feeder mechanism.

Figure 12:
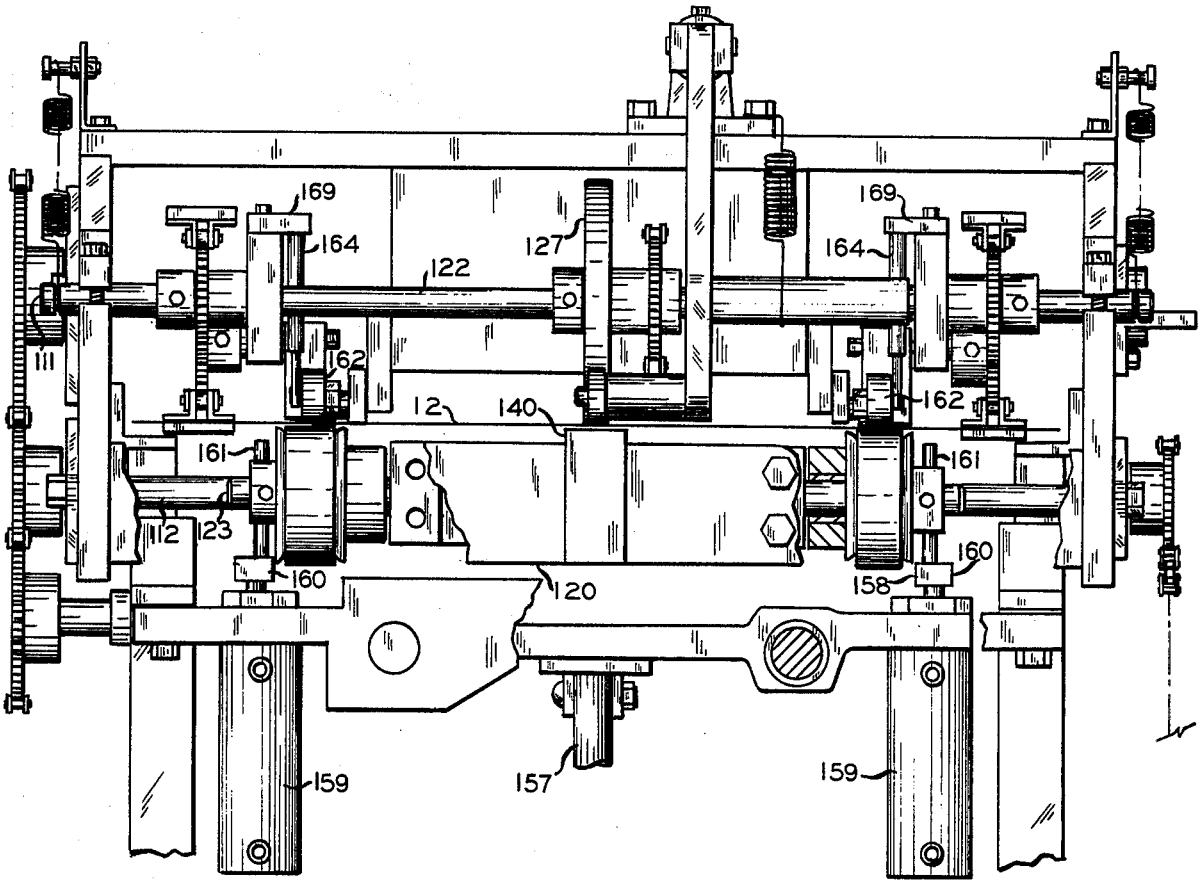

FIG. 12 is an end view of the feeder mechanism as seen from the feed end thereof.

Figure 13:
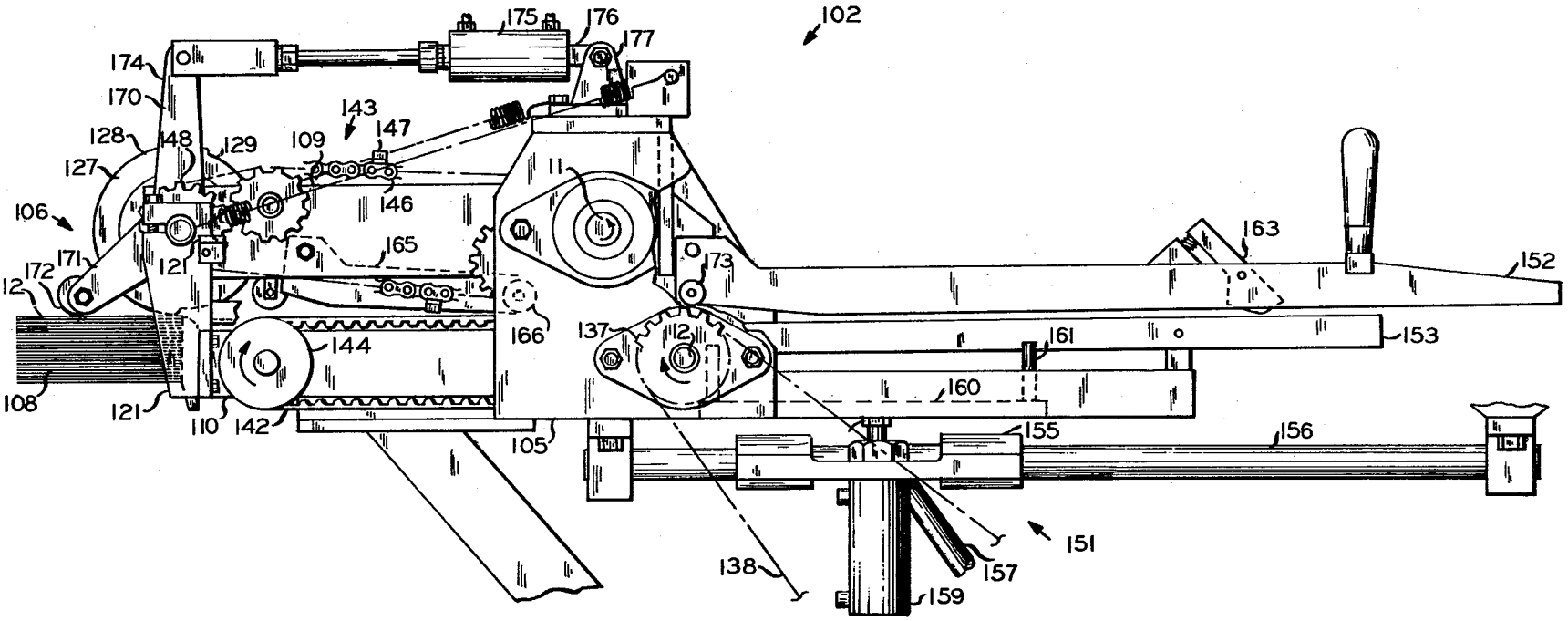

FIG. 13 is a side elevational fragmentary view of the feed means.

Figure 14:
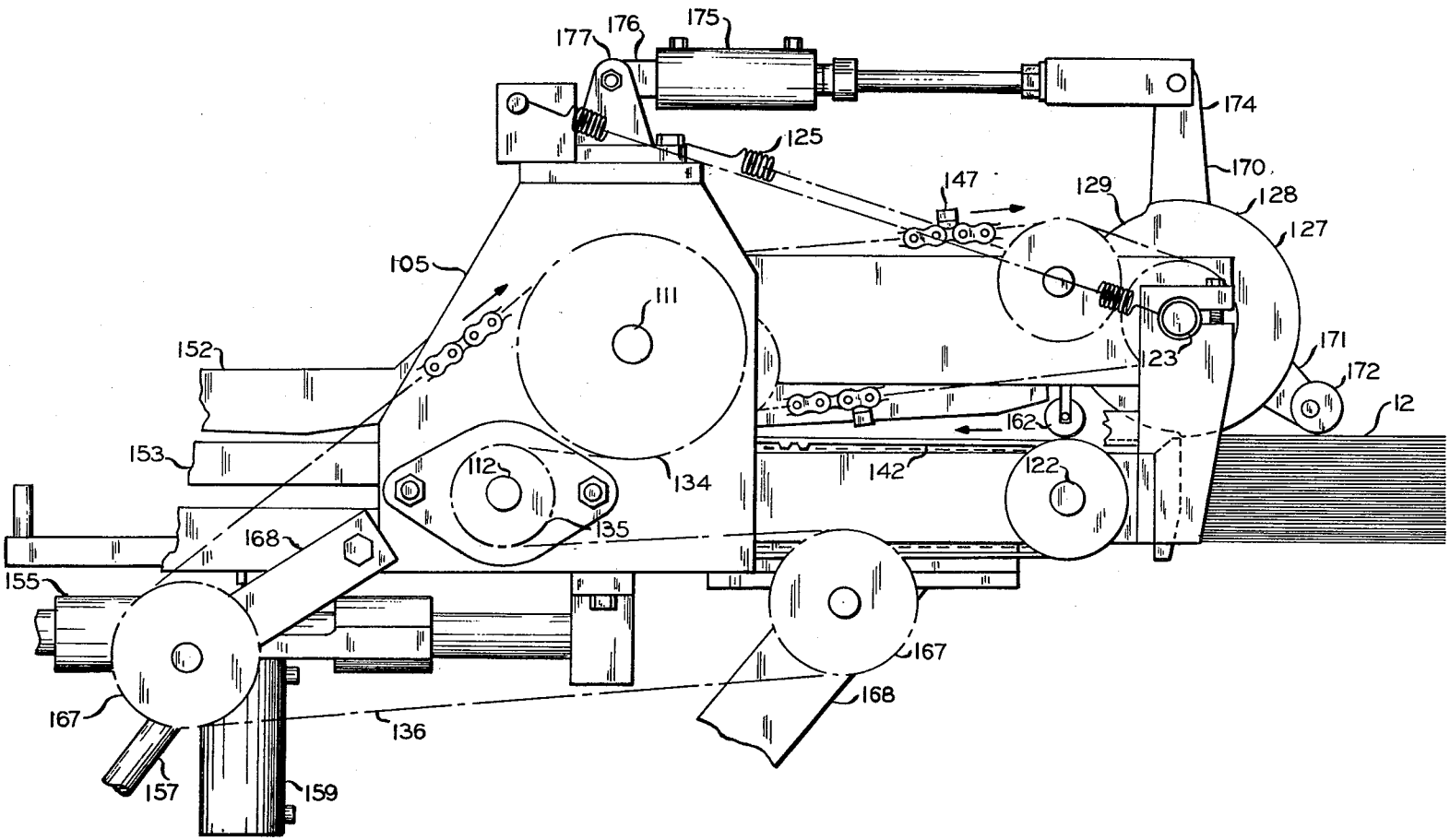

FIG. 14 is a fragmentary side elevational view of the feed apparatus as seen from the opposite side of FIG. 13.

Figure 15:
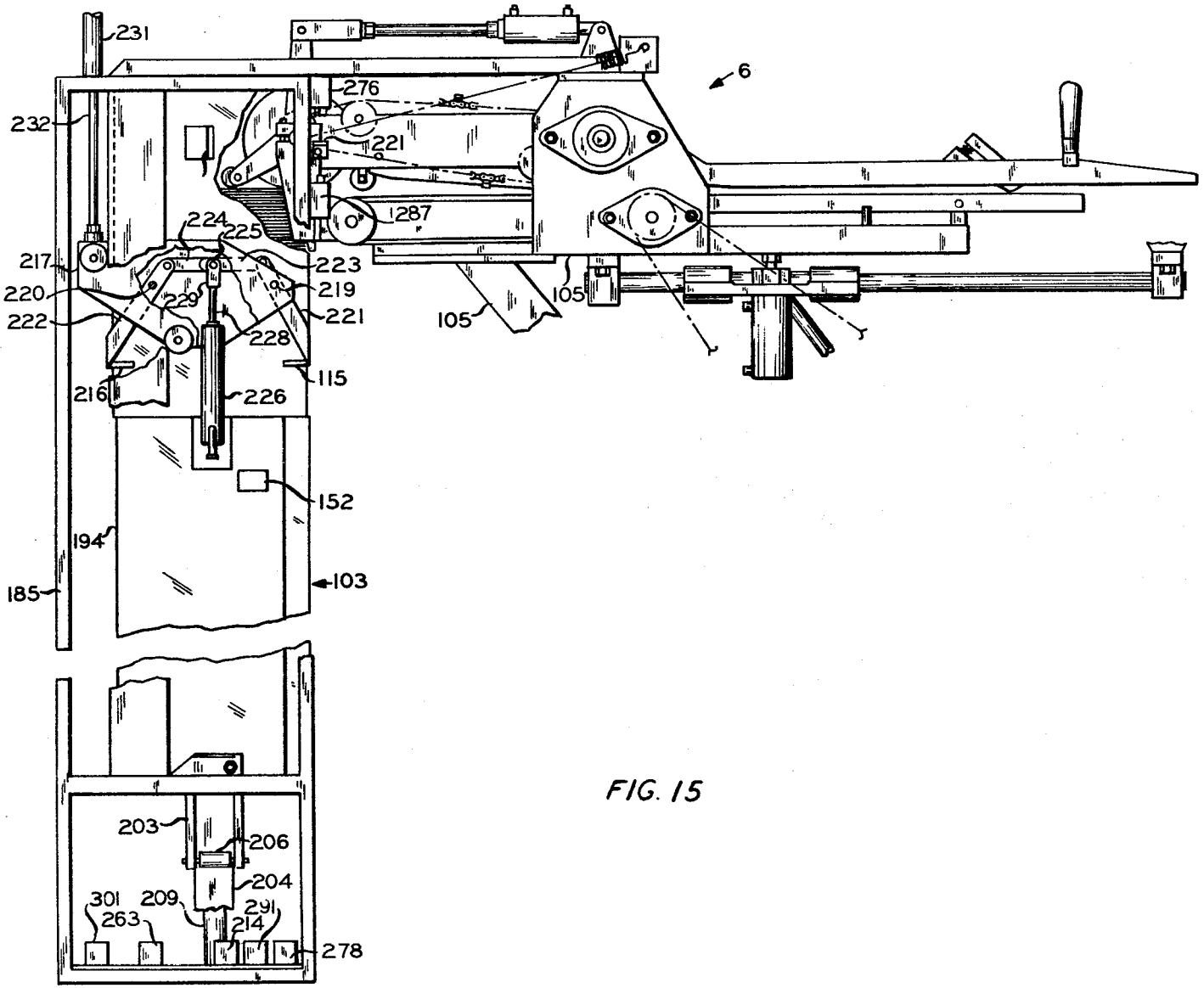

FIG. 15 is a side elevational view of the feed apparatus and a storage magazine.

Figure 16:
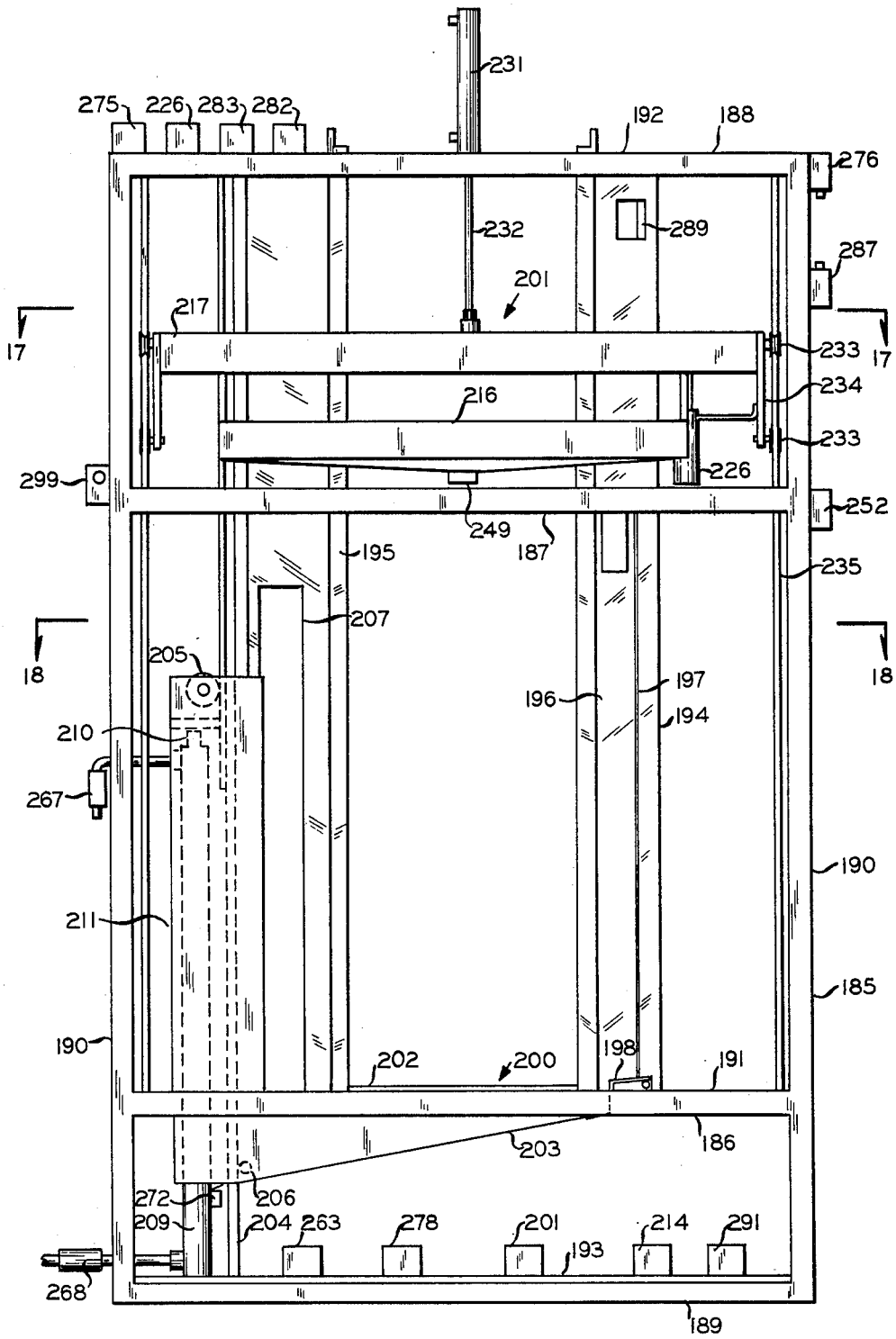

FIG. 16 is a front elevational view of the storage magazine.

Figure 17:
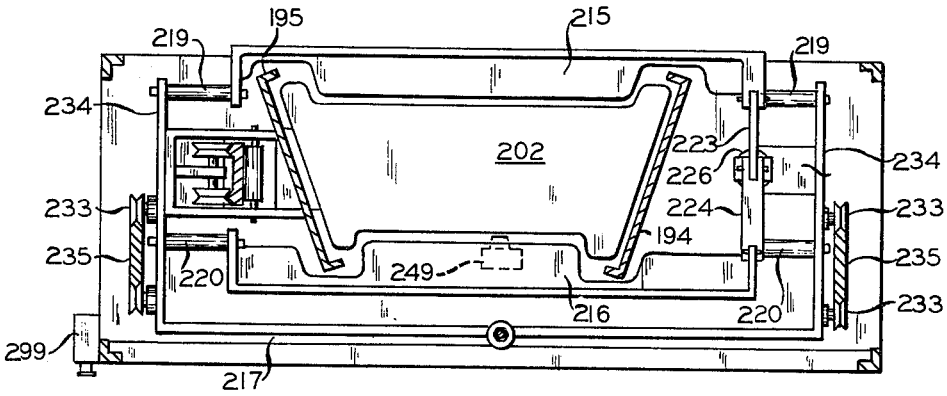

FIG. 17 is a sectional view of the magazine taken along the line 17—17 of FIG. 16.

Figure 18:
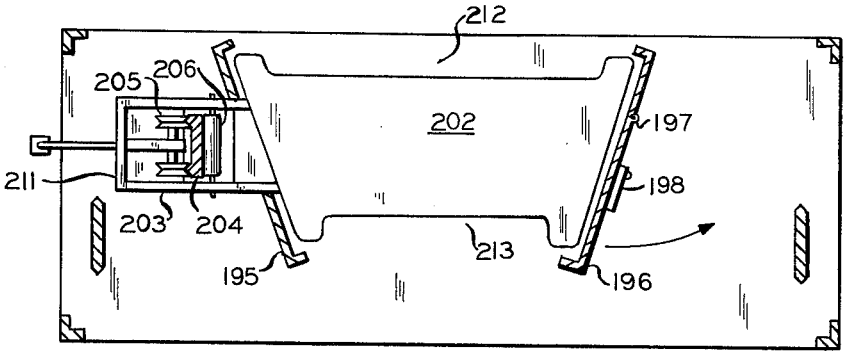

FIG. 18 is a sectional view of the magazine taken along the line 18—18 of FIG. 16.

Figure 19:
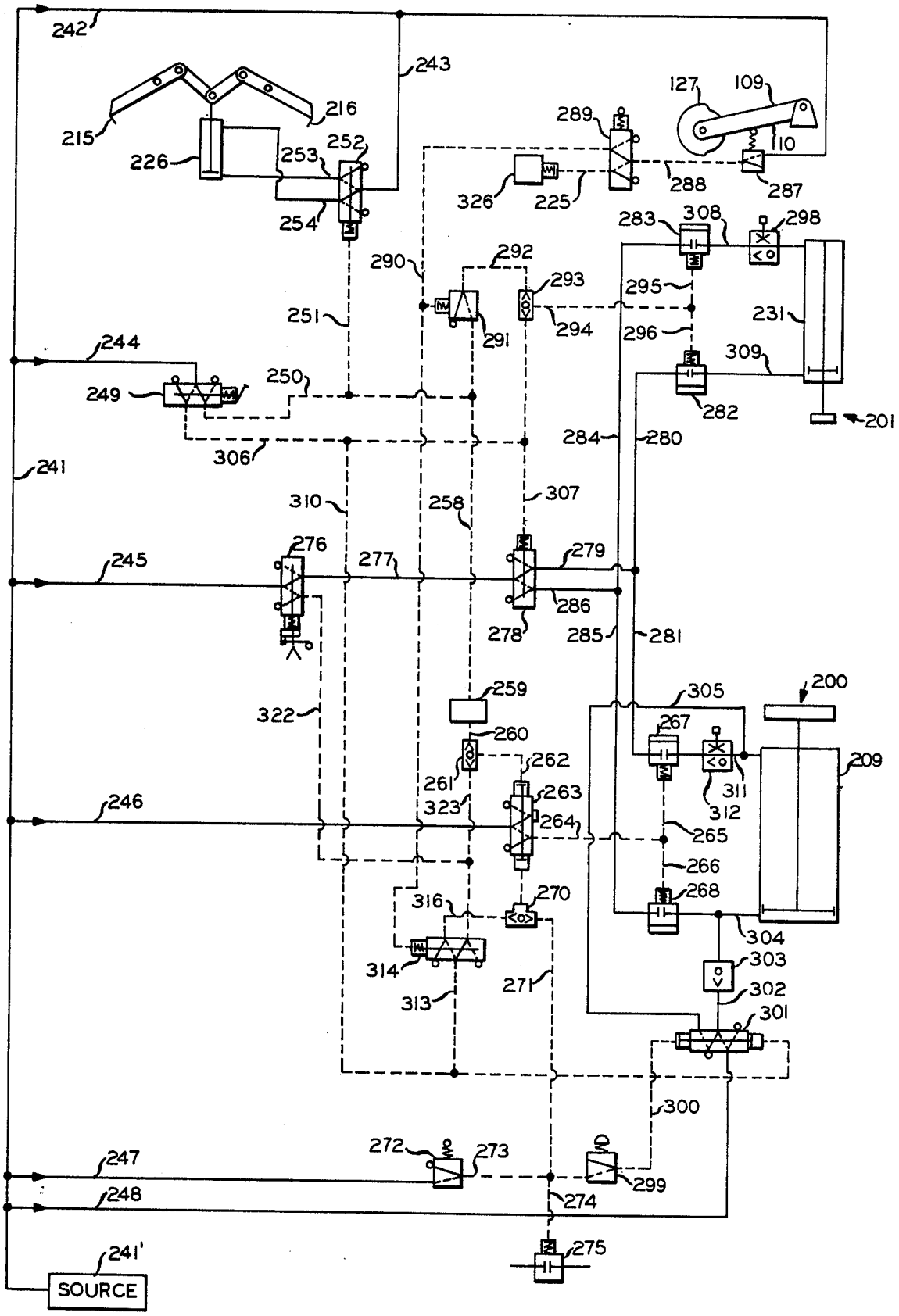

FIG. 19 is a schematic diagram of a control system used to control the operation of the various parts of the feeder magazine.

Figure 20:
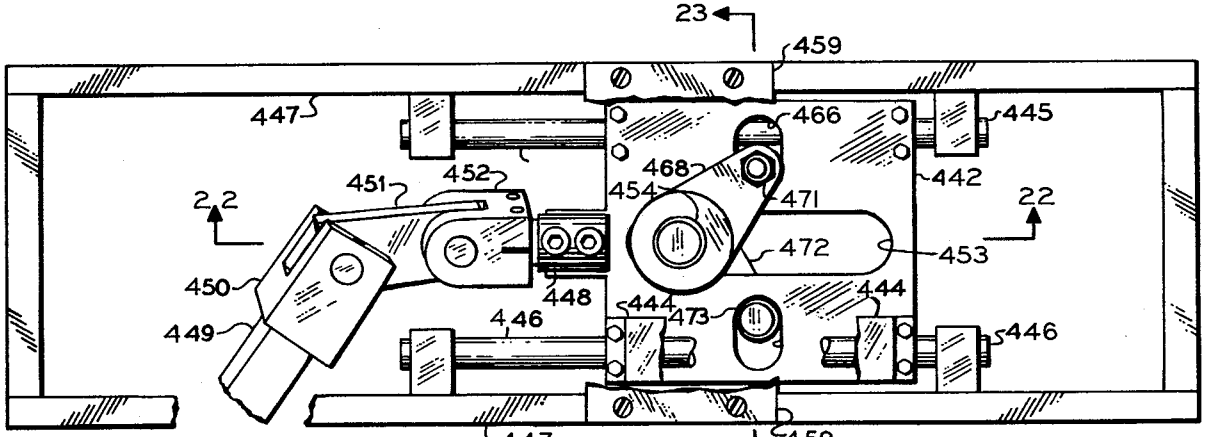

FIG. 20 is a plan view, partly in cross-section, of the mechanism of a side wall wrapping apparatus in an open position.

Figure 21:
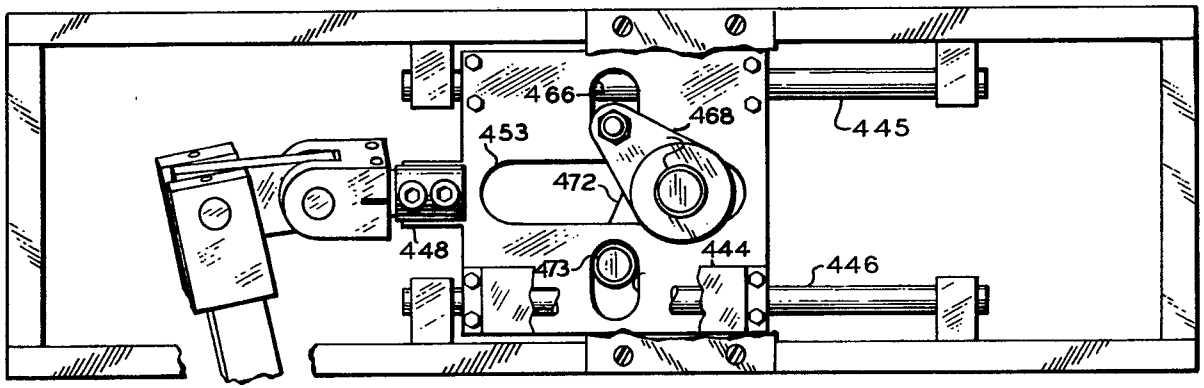

FIG. 21 is a plan view, partly in cross-section, of the mechanism of the side wall wrapping apparatus in the closed position.

Figure 22:
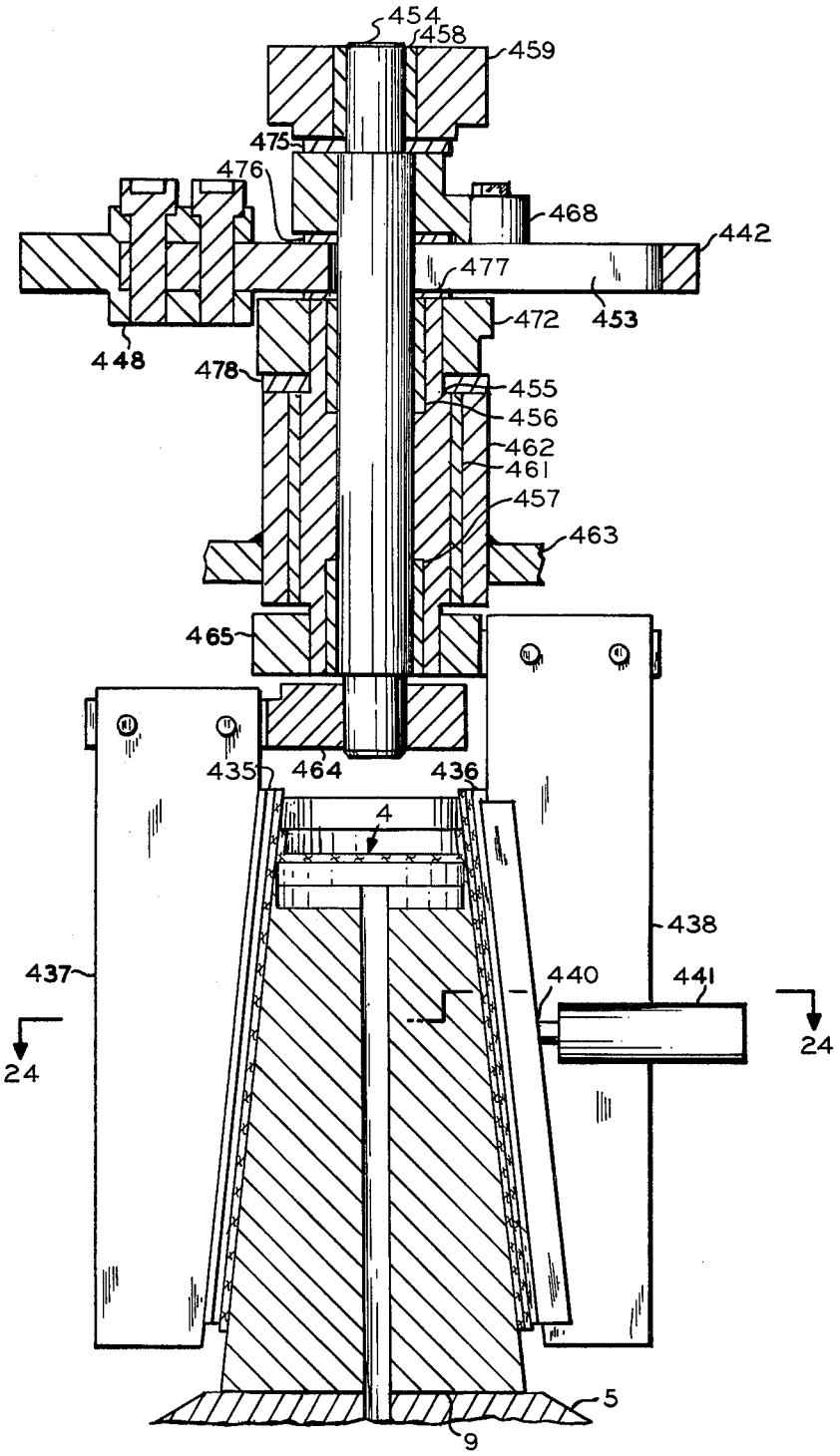

FIG. 22 is a partial elevational view in cross-section taken along the line 22—22 of FIG. 20.

Figure 23:
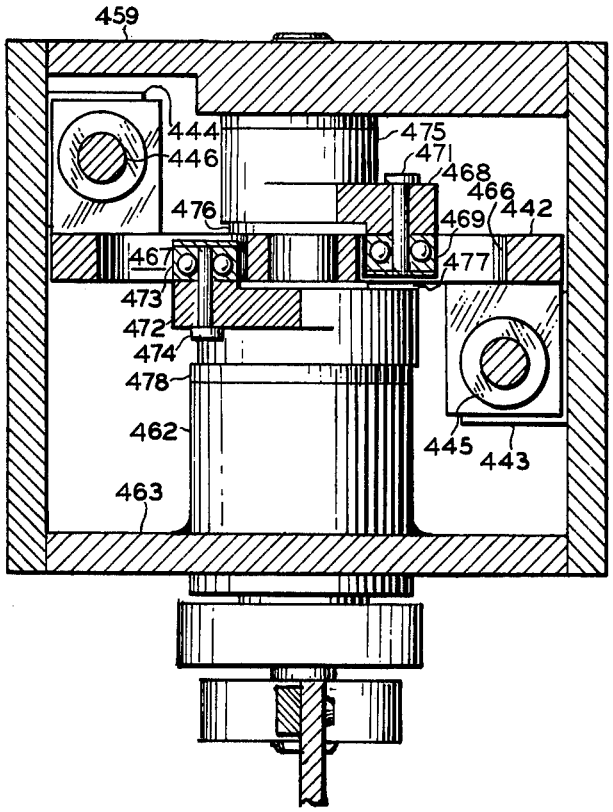

FIG. 23 is a cross-sectional view taken along the line 23—23 of FIG. 20.

Figure 24:
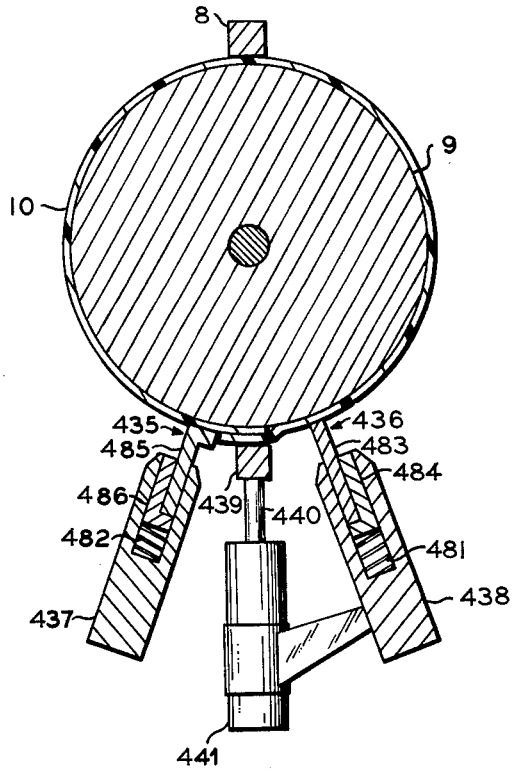

FIG. 24 is a cross-sectional view taken along the line 24—24 of FIG. 22.

Figure 25:
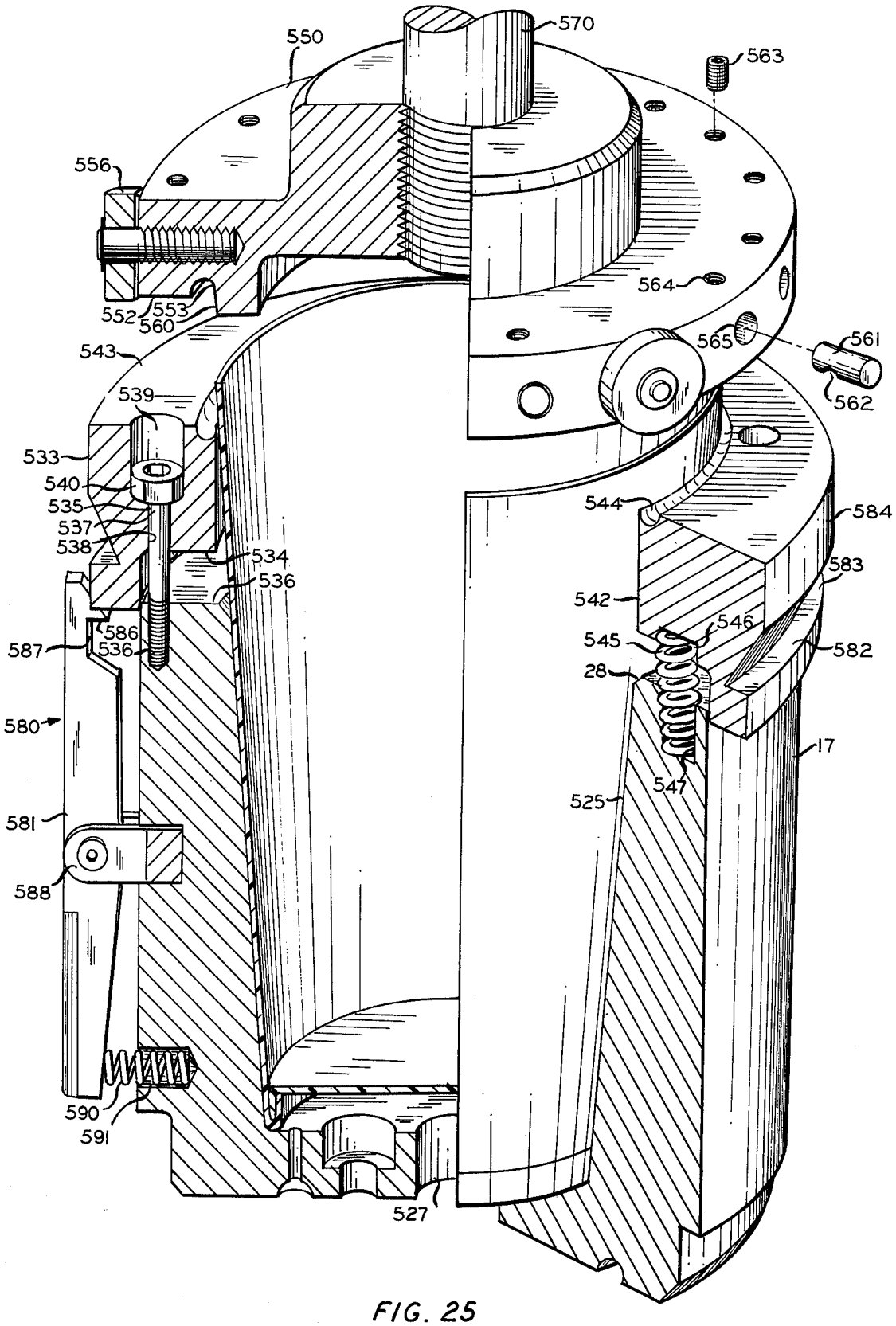

FIG. 25 is a perspective view of a portion of an apparatus used for forming beads on a container with the portion being a container receiving receptacle with portions thereof broken away to show structural details thereof with the forming head and ring being shown in a non-bead forming position.

Figure 26:
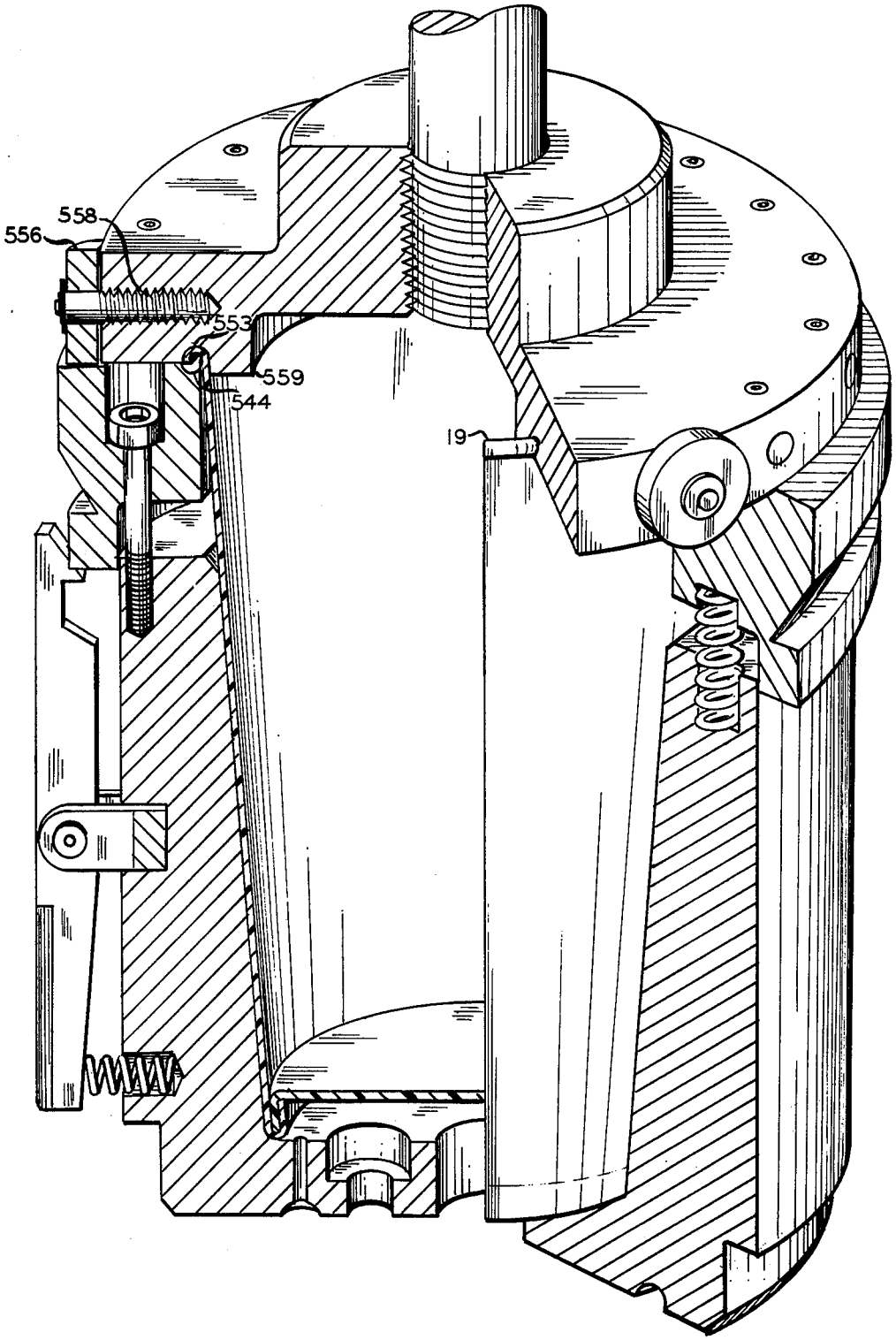

FIG. 26 is a view similar to FIG. 25 showing the forming head and ring cooprating to start the formation of the rolled bead or rim.

Figure 27:
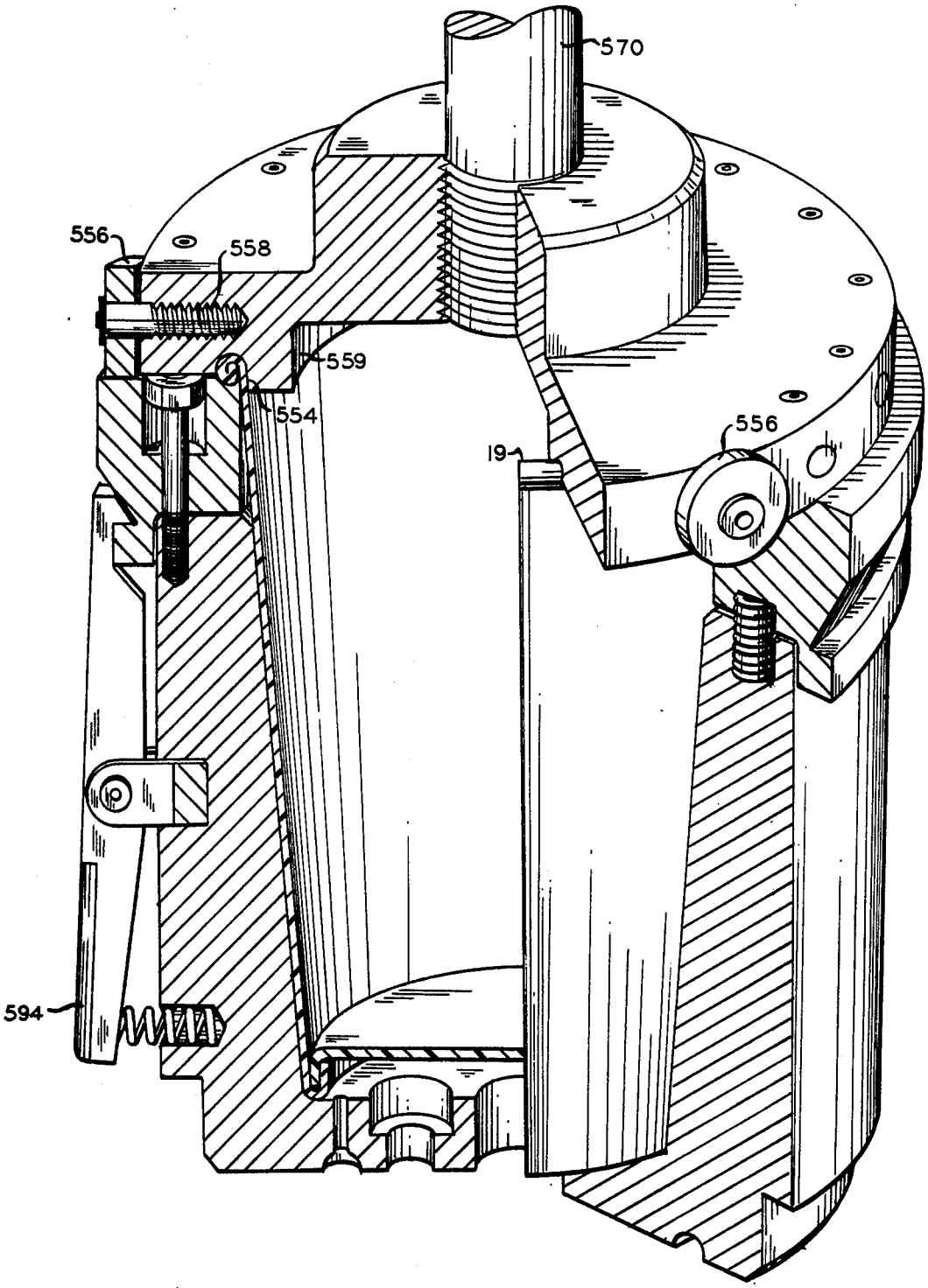

FIG. 27 is a view similar to FIGS. 25 and 26 showing the forming head and ring in a position which has completed the formation of the rolled rim.

Figure 28:
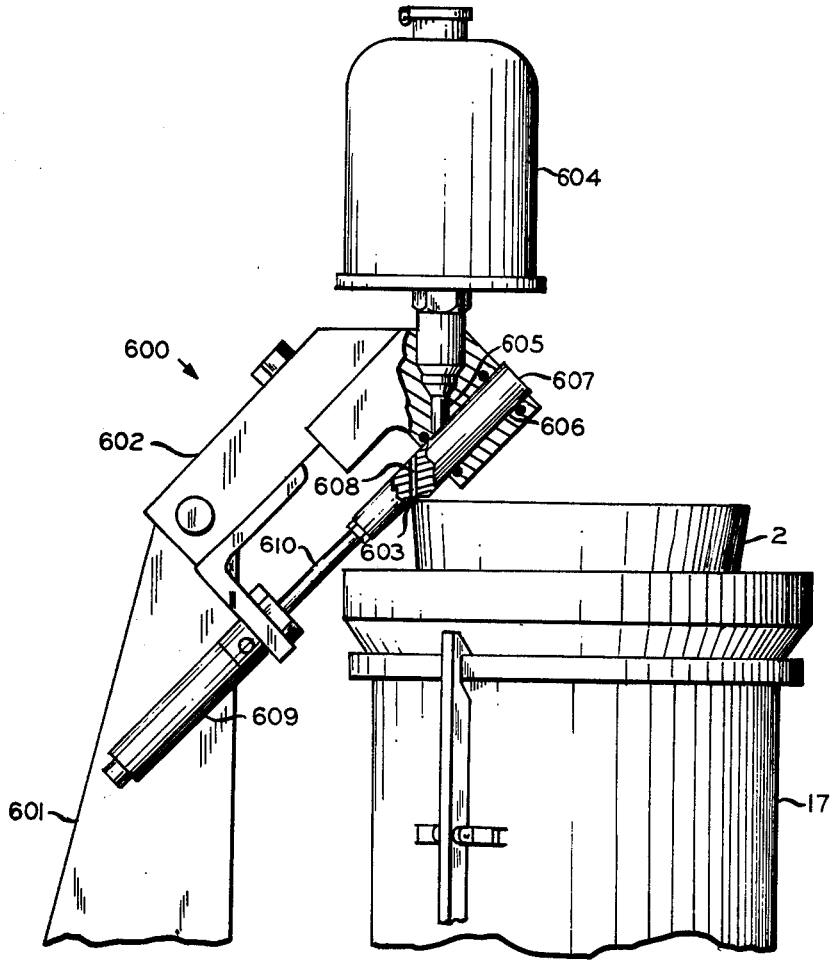

FIG. 28 is a fragmentary view of a lubricator used to lubricate an upper edge of a container blank.

Figure 29:
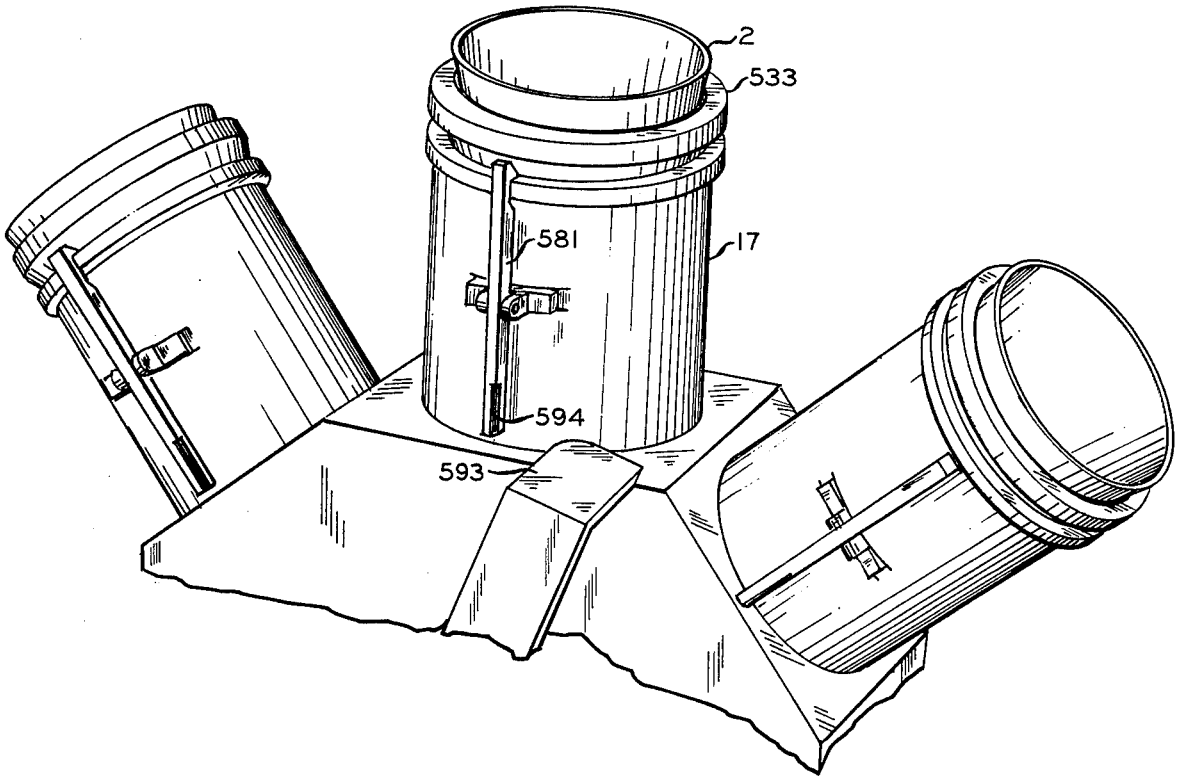

FIG. 29 is a fragmentary perspective view of a latch and latch release means which cooperate with the ring.

Figure 1:
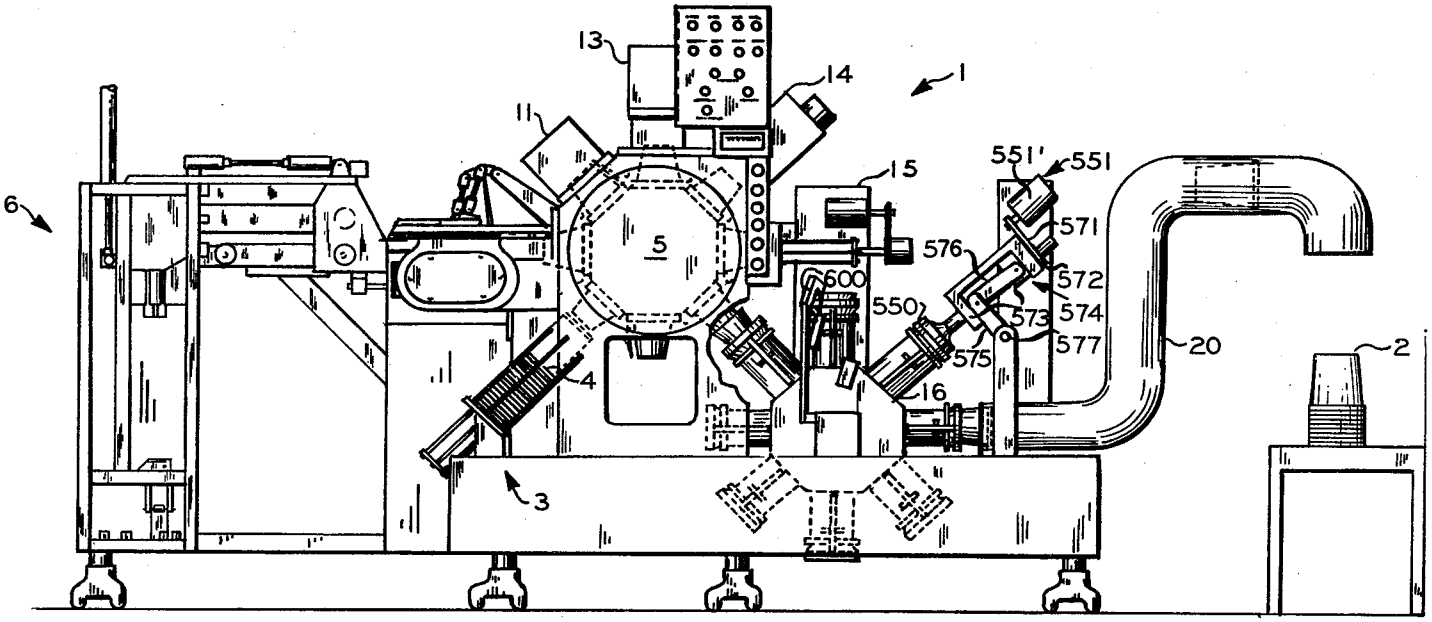
FIG. 1 is a side elevational view of an apparatus used for forming containers.
Figure 2:
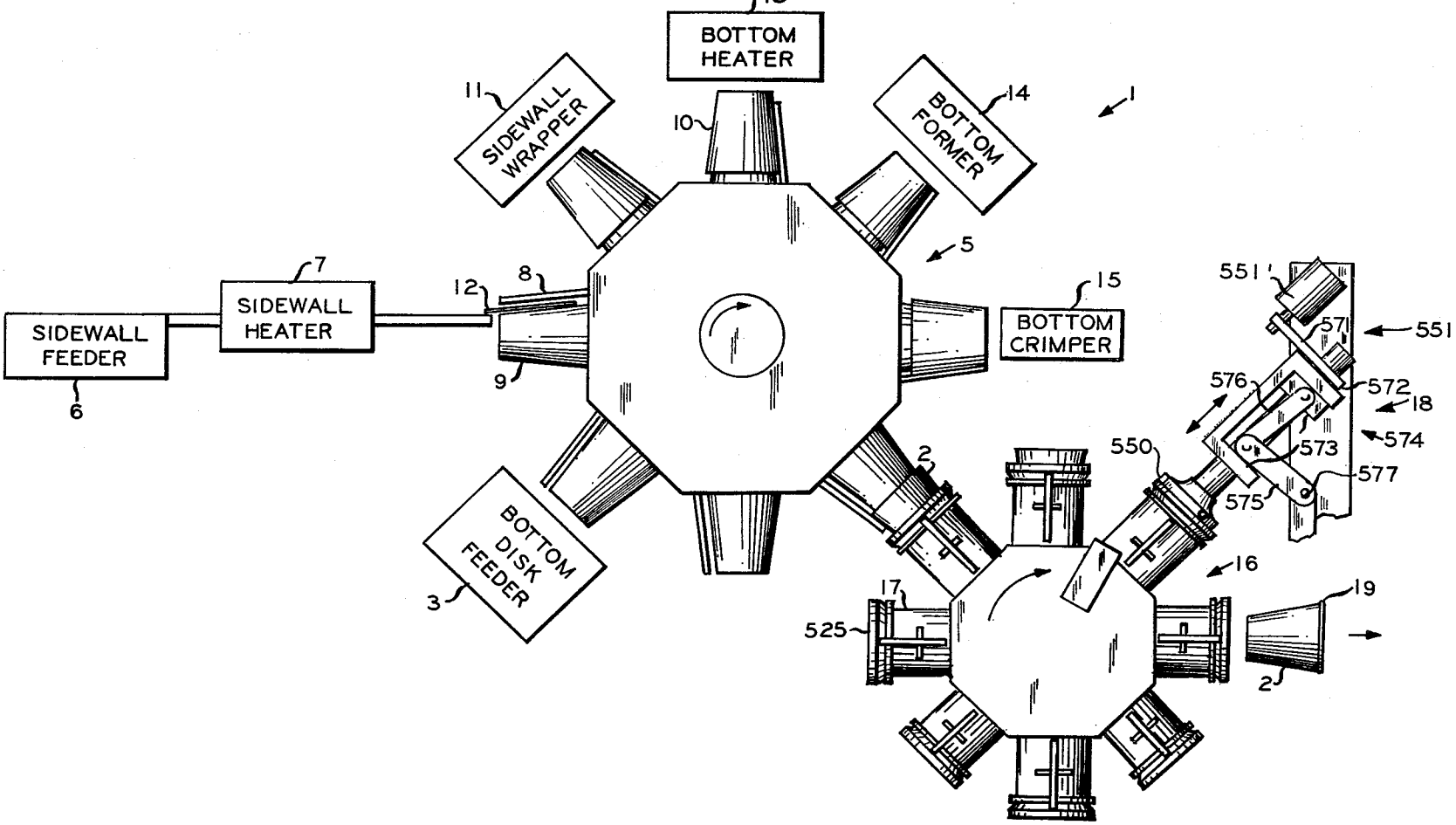
FIG. 2 is a schematic illustration of the apparatus of FIG. 1.
Figure 3:
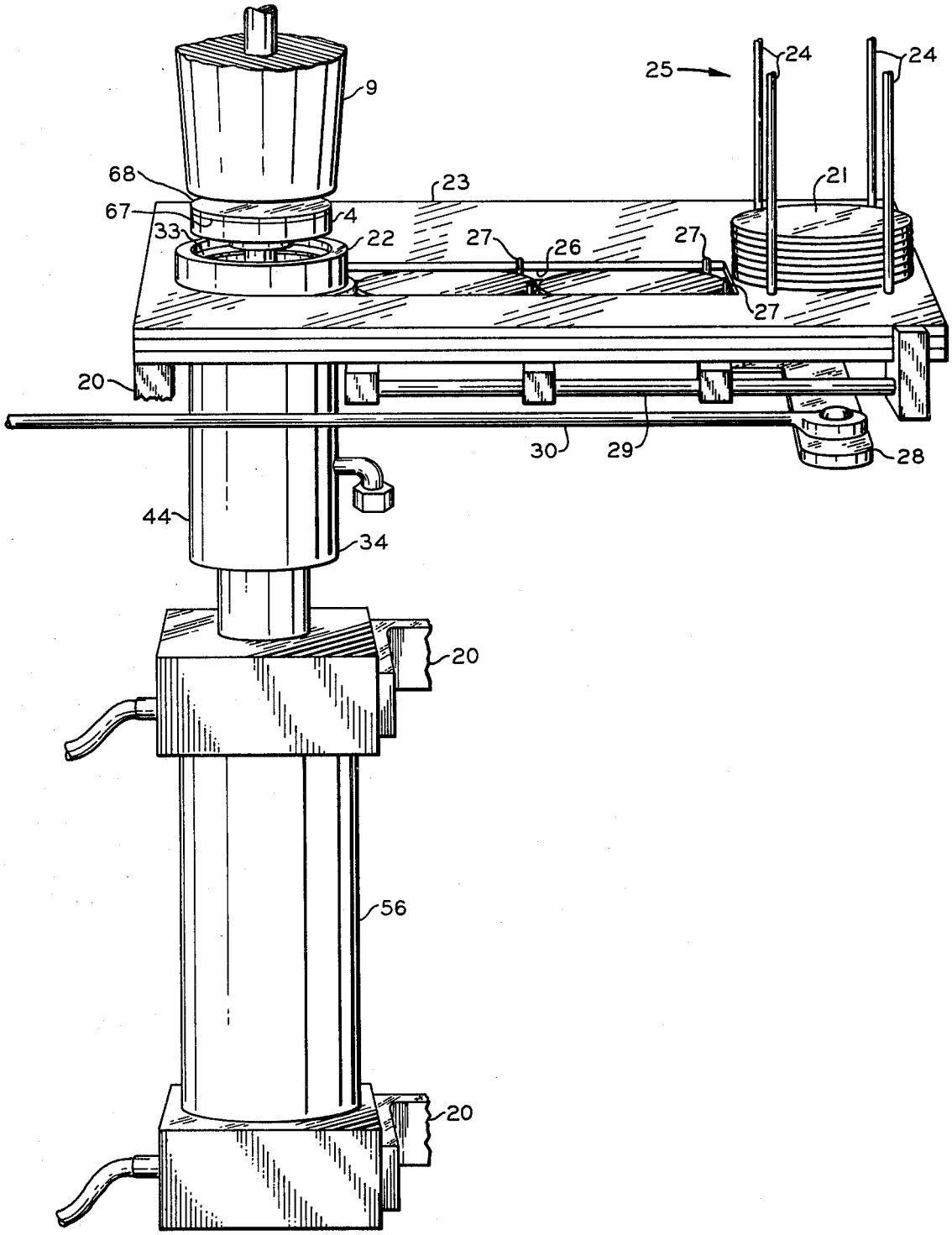
FIG. 3 is an enlarged fragmentary view of a portion of the container forming apparatus showing means for forming bottom members.

Referring more in detail to the drawings:

Referring to FIGS. 1, 2 and 10, the reference numeral 1 designates generally an apparatus for the forming or manufacture of containers such as the container 2. The apparatus 1 includes a bottom blank or disc feeder 3 which is operable to form bottom members 4 for the container 2. The feeder 3 feeds and positions bottom blanks prior to subsequent forming operations by other portions of the apparatus 1. The apparatus 1 includes a multiple head turret arrangement 5 which conveys various portions of the container in different stages of completion from one station to another station for different forming operations. As shown, the different stations include a side wall feeder means 6 from which side wall blanks 12 are fed to a suitable side wall heater 7 for heating side marginal portions thereof after which same are fed to one of the mandrels or heads on the turrent 5. A clamp member 8 holds the side wall blank 12 on one of the mandrels which carries a bottom member in the end thereof as described herein below for subsequent forming. A side wall wrapping means 11 is operable to wrap or convolute the side wall blanks 12 around the mandrel to form a side wall 10 of the container 2. Indexing of the turret 5 then moves the mandrel 9 having the wrapped side wall thereon and the bottom member carried thereby to a bottom heater 13 which is operable to heat the bottom member 4 and portions of the side wall 12 after which the mandrel is indexed to a bottom former 14 which folds a portion of the bottom of the container side wall in overlapping relation with a skirt portion of the bottom member 4 for later securing of same together. After this step, the partially completed container is then moved to a bottom crimper means 15 where the fold made by the bottom former means 14 is compressed preferably by fluted rollers, as is known in the art, to ensure engagement between the container side wall and the skirt of the bottom member. After the crimping, the partially completed container is then indexed to a point for discharge into another conveying means such as an indexable turret 16 which has a plurality of container receiving receptacles 17. Movement of the turret 16 moves the partially completed containers carried in the receptacles to a top bead or rim forming device 18 which is operble to form a bead 19 on one end of the container 2. Further indexing of the turret 16 moves the receptacle 17 containing a completed container to a position for ejection through an ejector 20 for ejection from the apparatus 1.

The above is a general description of the apparatus 1 with the various component parts being more fully described herein below. Certain portions of the apparatus are known in the art as, for example, the bottom heater 13, the bottom former 14 and the bottom crimper 15 and detailed descriptions of same are not included herein since same are known in the art and are incorporated herein by reference. The present apparatus is particularly well adapted for the manufacture of polymeric-coated paperboard containers which have a tapered sidewall with the bottom or closed end having a smaller diameter than the open upper end. However, it is to be noted that the present invention can also be used to manufacture containers having cross-sections other than circular and oppositely tapered or untapered containers of any suitable material.

The bottom member 4 is best seen in FIGS. 3–9, inclusive. As shown, bottom blanks 21 are fed to a forming die 22 by suitable means. In the illustrated structure the means include a support member 23 which has a storage magazine 25 formed by a plurality of upstanding members 24 and adapted to store a plurality of bottom blanks 21. Tracks 26 are provided along which bottom blanks 21 are moved from the magazine 25 to the die 22 such as by engagement with fingers 27. The fingers 27 are mounted on a carriage 28 which is slidably mounted on bearing rods or ways 29 with the carriage 28 being movable in response to actuation of a link 30 which is moved by power means (not shown) such as a pneumatic cylinder or other means such as a lever arm operable by the main drive shaft of the machine. The illustrated structure for feeding the bottom blanks and the extendable ram 56 are suitably supported on the frame (not shown) of the apparatus 1 such as by members 20. Movement of the carriage 28 in one direction indexes a bottom blank 21 into a position between the die 22 and plunger arrangement 34 as later described. Movement of the carriage in the opposite direction effects retraction of the fingers 27 so as to be out of engagement with a respective bottom blank and upon return of the carriage 28 the fingers 27 are extended by means (not shown) for engagement once again with a bottom blank 21.

Preferably, the die 22 is mounted on the support 23 and has open ends 32 and 33 whereby a bottom blank 21 is moved into position adjacent the open end 32 by movement of the carriage 28. The die 22 has a plurality of different size forming areas as does a plunger arrangement 34 whereby the die 22 and plunger 34 cooperate to form a bottom member 4 from a bottom blank 21. As shown, the die 22 has a through bore 35 with the plurality of forming areas, in the illustrated structure, being two in number and are denoted by the reference numerals 37 and 38. It is to be noted, however, that any number, two or more, of different sized areas can be provided in the die 22. Preferably, the bore 35 is transversely circular whereby the forming areas 37 and 38 have different diameters with the area 37 being larger in diameter than the area 38. Radiused corners 39 and 40 are provided for each of the areas 37 and 38, respectively, to provide a smooth lead-in for each of the areas. Preferably, a recess or annular groove 41 is positioned between the area 37 and area 38 and has a diameter larger than either of the areas. The groove 41 provides clearance for portions of the bottom member 4 to facilitate the forming operation as later described. A circumferential flange 42 is provided on the exterior of the die 22 to facilitate mounting of same on the support 23.

The plunger arrangement 34 in the illustrated structure includes a plurality of relatively movable portions having different sizes to cooperate with the different sized forming areas 37 and 38. As shown, the plunger arrangement includes a first plunger 44 and a second plunger 45. Preferably, the second plunger 45 is carried by the plunger 44 and has means cooperating therewith to move same independently of the plunger 44. As shown, the plunger 44 is provided with a cylinder-forming bore 46 which has a plunger receiving pocket 47 adjacent the open end thereof. The plunger 45 is sized to be received in the pocket 47 for its retracted position and has a rod 48 extending through a bore through a bearing block 49 and has a piston-forming end 50 received within the bore 46 forming a pneumatic extendable ram. A spring 51 is positioned between the bearing block 49 and the piston end 50 to effect return of the piston 45 to its retracted position in the pocket 47. An air passage 52 communicates with the bore 46 and is operable to supply pressurized air thereto for extension or movement of the piston 45 from the pocket 47 as described below. Extension or movement of the plunger 45 is limited by a stop 53, secured to the piston end 50, when it engages the bearing block 49 which is retained against movement by a keeper 55.

Figure 4:
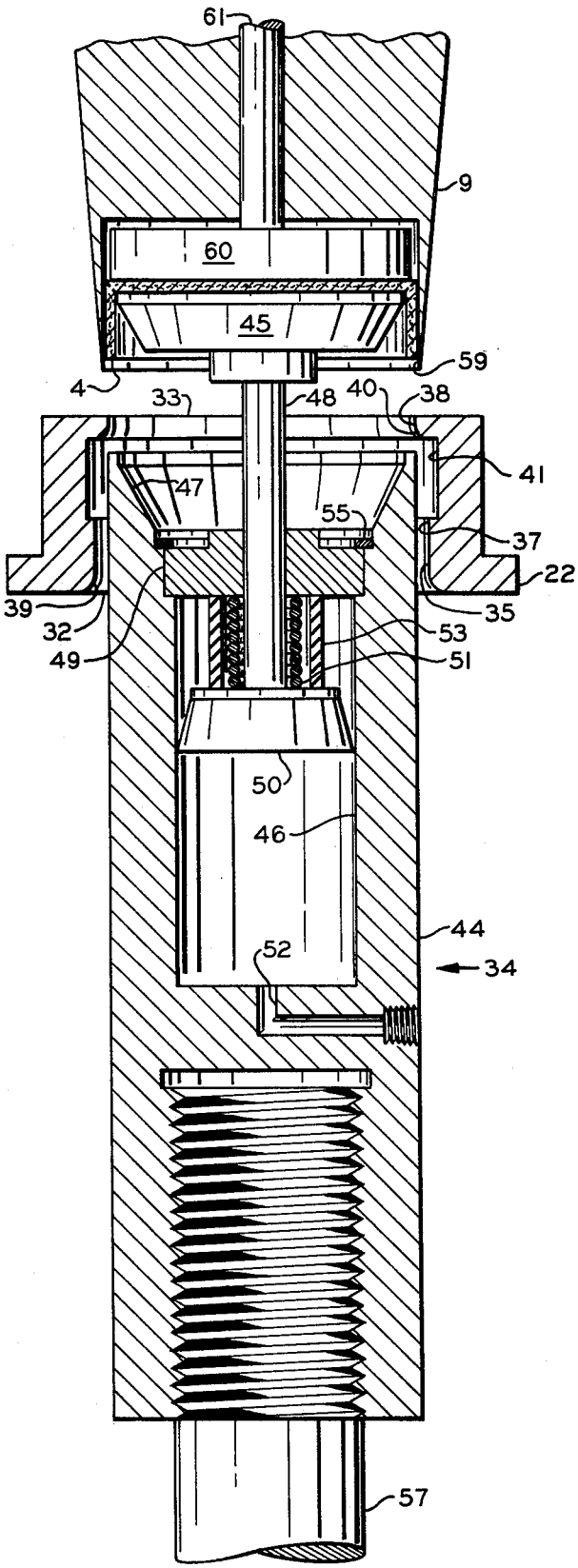
FIG. 4 is an enlarged fragmentary sectional view of means for forming bottom members.
Figure 5:
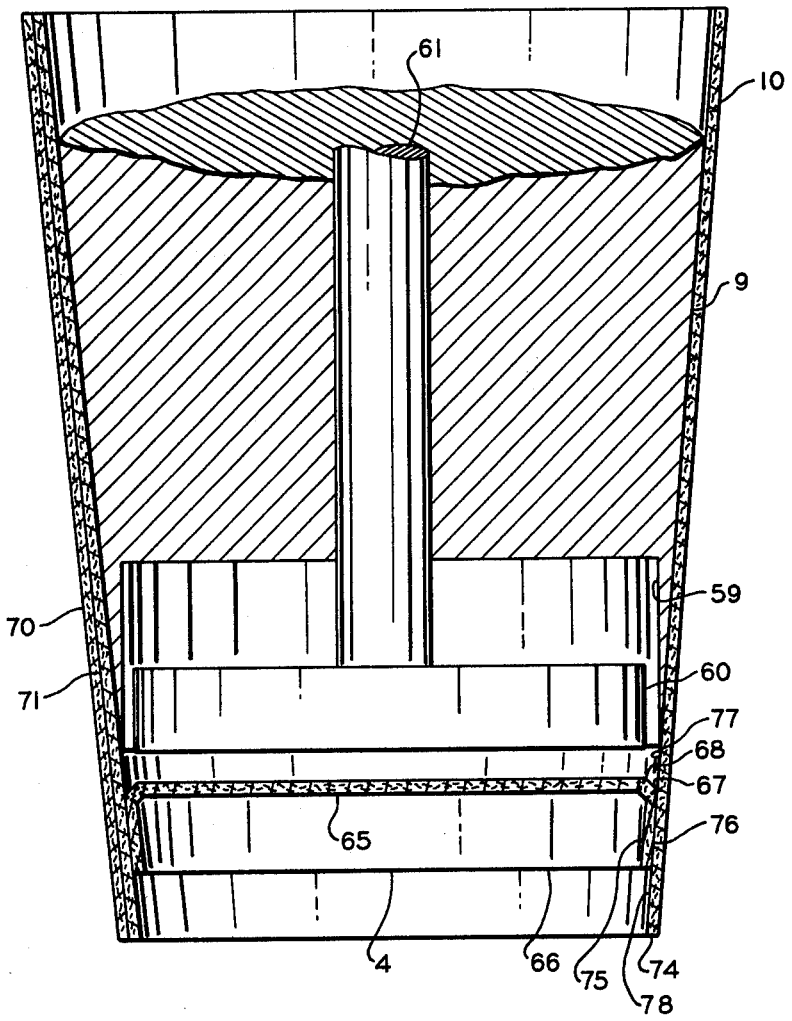
FIG. 5 is an enlarged fragmentary sectional view of a portion of the container forming apparatus showing container portions.

The plunger arrangement 34 has means cooperating therewith to effect movement of same into and out of the die 22. As shown, the plunger arrangement 34 is mounted on an extendable ram 56 as by threaded engagement with a piston rod 57. In the illustrated structure, extension of the ram 56, which preferably is a pneumatic ram, effects movement of the plunger arrangement 34 into the die 22 with the movement of the plunger 44 being limited so that movement will terminate just prior to entering the forming area 38. Pressurized air is supplied the cylinder-forming bore 46 to then extend the plunger 45 through the forming area 38 and into a bottom member receiving pocket 59 in a mandrel 9. As best seen in FIGS. 4 and 9, the pocket 59 opens or faces generally toward the plunger arrangement 44 and die 22 when the mandrel 9 is adjacent the feeder 3. As shown, the mandrel 9 has an ejector 60 movably mounted in the pocket 59 with an actuator rod 61 extending through a bore in the mandrel 9 for selective movement of the ejector by means (not shown). Preferably, the ejector 60 has a diameter less than the diameter of the pocket 59 for a purpose to be later described.

The present invention is more fully understood by a description of the operation thereof. At the start of operation of the apparatus 1, with plunger arrangement 34 spaced from the forming area 37 and the plunger 45 retracted into pocket 47, a bottom blank 21 is fed beteeen die 22 and plunger arrangement 34 adjacent the open end 32. The ram 56 is then actuated to extend or move the plunger arrangement 34 to a position whereby the plunger 44 is in engagement with the bottom blank 21. As best seen in FIG. 6, the plunger 44 forces the bottom blank 21 into the forming area 37, forming the bottom blank 21 into bottom member 4 with a bottom panel 65 and a depending skirt 66 and a first fold or score line 67 therebetween. As best seen in FIG. 7, further movement of the plunger 44 moves the bottom member 4 to a position where the skirt 66 is received within the groove 41 to substantially eliminate frictional engagement between portions of the die 22 and plunger 44 and the skirt 66 to facilitate further movement of the bottom member 4. Movement of the plunger 44 is limited or terminated such as by limiting the stroke of the ram 56.

As best seen in FIGS. 4, 8 and 9, after movement of the plunger 44 is terminated, pressurized air is supplied to the cylinder-forming bore 46 to effect extension of the plunger 45 through the forming area 38. Because the forming area 38 has a smaller diameter than the forming area 37, a second fold or score line 68 is formed on the bottom member 4 and is positioned inside of the score line 67 and preferably is concentric therewith. Further movement of the plunger 45 moves the bottom member 4 into the pocket 59 whereby the diameter of the score line 68 is substantially equal to or just slightly less than the diameter of the pocket 59. Preferably the plunger 44 is spaced from the surface defining the forming area 37 and the plunger 45 is spaced from the surface defining the forming area 38 a distance substantially equal to or slightly larger than the thickness of the bottom blank 21. It is to be noted that the smaller fold line 68 allows easy insertion of the bottom member 4 into the pocket 59 and the larger fold line 68 allows intimate contact of the skirt 66 with the sidewall 10 as described below. After inserting the bottom member 4 into the pocket 59, the plunger 44 and 45 are retracted from the die 22 and pocket 59. Referring to FIG. 2, with the bottom member 4 in position in the pocket 59, the mandrel 9 is moved to a position adjacent the sidewall heater 7 and sidewall feeder whereby a sidewall blank 12 is suitably moved into engagement with the mandrel 9 and held there by the clamp 8. After this operation, the mandrel 9 is then indexed to the sidewall wrapper 11 which is operable to convolute or wrap the sidewall around the mandrel 9 forming an overlap or seam 70. The overlapping portions of the sidewall blank 12 are secured together in any suitable manner such as by adhesion of the sidewall coating such as polyethylene to join same as at 71 and thereby form the sidewall 10. At best seen in FIG. 5, a portion of the sidewall 10 extends past the end of the mandrel 9 and when the mandrel 9 is indexed to the bottom heater 13, the ejector 60 is actuated to move the bottom member 4 out of the pocket 59 whereby the skirt 66 flares outwardly with the score line 68 having a diameter substantially equal to or slightly larger than the diameter of the container 2 at the point at which movement of the bottom member 4 is terminated. It is seen that the diameter of the ejector 60 is small enough so as not to engage the sidewall 10 during ejection of the bottom member 4. The bottom member 4, particularly the skirt 66 and the lower portion of the sidewall 10 are heated by the bottom heater 13 and are then moved to the bottom former 14 whereby same are secured together as by adhesion of the coating therebetween. The bottom former 14 also reverse bends a lower portion 74 of the sidewall 10 to partially overlie an interior surface 75 of the skirt 66. As best seen in FIG. 10, the bottom member 4 has the exterior surface 76 of the skirt 66 secured to the interior surface 77 of the sidewall 10 and the interior surface 75 of the skirt 66 is also secured to a surface portion 78 of the interior surface 77. The finished container is then indexed to a position for ejection into the container receiving member 17 of the turret 16 after which a bead 19 is formed on the open end of the container 2 by the top bead former 18.

As best seen in FIGS. 11 through 19, the reference numeral 6 designates generally an apparatus for supplying and feeding sheets of material to a point of use which is illustrated is a mandrel 9 carrying a bottom member 4. The apparatus 6 includes a feeding means 102. The feeding means 102 includes a support 105 of any suitable type and can be a portion of or secured to a portion of the machine 1 which uses the sheets fed thereto. The feeding means 102 includes a means 106 for individually removing a blank 12 from a stack 108 thereof (see FIG. 13). In the illustrated structure the feed means 102 includes first and second arm means 109 and 110, respectively, which are pivotally mounted on the support 105 in any suitable manner as, for example, by the first arm means being pivotally mounted on a shaft 111 and the second arm means being pivotally mounted on a shaft 112. Preferably the shafts 111 and 112 are rotatably mounted on the support 105. The arm means 109 and 110 extend in a generally horizontal plane and have ends 114 and 115 pivotably mounted on shafts 123 and 122, respectively. Although other arrangements are feasible, the illustrated structure shows that each of the arm means is comprised of a spaced apart pair of arms wherein the first arm means 109 includes arms 116 and 117 and the second arm means 110 includes arms 118 and 119. The pivotal mounting can be by any suitable means and, as shown, the shaft 122 is rotatable within the arms 118 and 119 and the arms 116 and 117 are rotatable about fixed shaft 123. A throat-supporting member 120 is also pivotally mounted on shaft 122 by connecting members 120A. The member 120, which as shown, includes the connecting members 120A and end plates 121, form a rigid link between the first and second arm means 109 and 110 whereby the first and second arm means 109 and 110, member 120 and support 105, form a four bar linkage arrangement which has the components thereof movable relative to one another. Counterbalance means is provided to help support the weight of the first and second arm means 109 and 110 and the parts carried thereby to reduce the downward force applied by same to the stack 108. Any suitable means can be provided and, as shown, a plurality of springs 125 extend between a portion of the support 105 and the first and second arm means 109 and 110.

The feeding means 102, as shown, includes a rotatable friction member 127 which preferably is suitably mounted on the shaft 123 and is shown as a wheel which has a peripheral friction surface 128 which is engageable with a blank 12 for selectively feeding same to portions of conveying means described below. As is known in the art, the friction member 127 is provided with a recessed or reduced diametral portion 129 wherein the spacing between the enlarged diametral portion and the reduced diametral portion is preferably slightly greater than the thickness of one blank whereby the friction member 127 can be continually rotated while selectively and sequentially feeding a blank to portions of the conveying means. The friction member 127 is attached to a hub 127A and sprocket 131 for rotation about the nonrotatable shaft 123 and operably connected to a drive means for effecting rotation of the friction member 127. In the illustrated structure the chain and sprocket drive arrangement is provided to positively drive the friction member 127 synchronously with other portions of the apparatus 6. The chain 130 is operably engaged with sprockets 131 and 132 and the sprocket 132 is rigidly mounted on the shaft 111 for rotation with the shaft 111. Preferably, the shaft 111 is driven by a sprocket 134 connected by a chain 136 to a sprocket 135 and since rotation of the shaft 111 should be synchronized with rotation of various other portions of the apparatus as described hereinbelow, a chain and sprocket drive arrangement connects the shaft 111 to the main drive via the shaft 112. A sprocket 137 is also mounted on the opposite end of shaft 112, as best seen in FIG. 13 and a chain 138 connects the sprocket 137 to a main drive (not shown) of the apparatus.

As shown, the member 120 has a throat-forming member or portion 140 thereon and preferably projects above an upper edge of the member 120 as best seen in FIG. 12 and is spaced from the large diametral portion of the friction member 127 a distance substantially equal to the thickness of one blank 12 so that only one blank can be fed through a throat formed between the wheel 127 and the member 140. Because a four-link linkage arrangement is formed between the first and second arm means 109 and 110, the member 120 and the support 105, the angular position of the member 120 and hence the portion 140 thereof, remain in substantially the same angular position relative to a fixed plane throughout pivoting movement of the first and second arm means 109 and 110 and the member 120. This will occur if the shafts 111 and 112, 122 and 123 are positioned to form a parallelogram of the arm means 109 and 110, member 120 and support 105 which is the preferred embodiment of this invention. Preferably the portion 140 travels in a generally vertical plane throughout the pivoting movement of the first and second arm means 109 and 110. Such movement helps prevent missed feeds of the blanks 12. It is to be noted, however, that the portion 140 will move slightly in a horizontal plane relative to the stack 108 during pivoting movement of the first and second arm means 109 and 110. However, it has been found that this slight horizontal movement is not detrimental to the feeding efficiency of the apparatus.

The blank 12 after being fed through the throat is picked up by conveying means to transfer same to a point of use from the stack or source of blanks. In the form shown, the conveying means includes at least one friction conveying member 142 and a positive drive means 143. As shown in FIGS. 11 and 13, there are a plurality of friction members 142, which can be flexible rubber belts, each operably connected to a respective pair of pulleys 144. Preferably, the pulleys 144 include two pulleys rigidly mounted on the shaft 112 to be driven thereby and two pulleys rigidly mounted to rotate with the shaft 122. The pick-up or infeed end of the belts 142 is positioned adjacent the throat member 140. The positive drive means 143, as shown, includes a pair of chains 146 each having a plurality of abutments or dogs 147 secured thereto in spaced apart relation with the spacing between the abutments 147 being greater than the width of a blank 12 at the point of contact therewith. Preferably, the chains 146 are driven by shaft 111 at a speed less than the speed of the belts 142 whereby frictional engagement of the belts 142 with a blank 12 urges the leading edge of the blanks 12 into engagement with a leading abutment 147 to retain the blanks in a proper indexed position. Pairs of sprockets 148 and 149 each have a respective chain operably engaged therewith wherein preferably the sprockets 148 are rotatable about the shaft 123 and the sprockets 149 are secured to the shaft 111 and are driven thereby. This synchronizes the friction member 127 with the movement of the abutments 147 to assure proper feeding of the blanks 12.

Preferably, there is a second portion to the conveying means which will receive a blank 12 from the chain and belt arrangement described above for further conveying of the side wall blank. After discharge from the first portion of the conveying means a second conveying means 151 receives the blank 12 and feeds same to a point of use as, for example, a container-forming apparatus. The conveying means 151 should accurately position the side wall blank 12 and retain same in a predetermined position so that the end use apparatus 1 can pick same up from an accurately determined position whereby the blank can be properly processed for an end use. In the illustrated structure, the conveying means 151 includes means forming a blank guide whereby the blank is held in a predetermined (as shown) horizontal position. The guide means as shown includes spaced apart bars 152 and 153 with two spaced apart pairs of the bars being provided for supporting opposite sides of the blank 12. The blank 12 rests on the bars 153 and upward movement of the blank is prohibited or prevented by the bars 152. A carriage 155 is movably mounted on guides 156 for longitudinal reciprocal movement. The guides 156 are supported on the frame of the machine with the carriage being operably connected to the main drive (not shown) by an arm 157 so that the carriage 155 can be moved synchronously with the first portion of the conveying means described above. As best seen in FIGS. 13 and 15, movement to the right of the carriage 155 will move a side wall blank toward a point of use. The conveying means 151 also includes a reciprocally mounted transfer mechanism 158 which is mounted on the carriage 155 for movement therewith. The transfer mechanism has means for moving same generally normal to the direction of travel of the carriage 155 (vertically as seen in FIG. 13) and as shown this means includes an extendable and retractable ram 159 mounted on the carriage 155. A support 160 is secured to the ram 159 and has a pair of spaced apart upstanding fingers 161 secured thereto. During forward or feeding movement of the carriage 155 the ram 159 is extended from the position shown in FIG. 13 whereby the fingers 161 engage the blank 12 and the carriage 155 moves the sidewall 12 held between bars 152 and 153 to the point of use. As seen in FIG. 12, there is a pair of the transfer mechanisms 158 each positioned on an opposite side of the feeding means 102 so that the fingers 161 will engage opposite ends of the blank 12. During feeding or forward movement of the carriage 155, the blank is fed to a position for use while being accurately positioned by the fingers 161 and the bars 152 and 153. After the fed side wall blank is picked up by another portion of a using apparatus the fingers 161 are moved to a retracted or down position and the carriage 155 is then retracted or moved back to a start position whereby the transfer mechanisms are ready to be extended to pick up another side wall blank 12 for feeding.

Preferably, the sidewall heater 7 of any suitable type, such as those already known in the art, is positioned in the second portion of the conveying means for heating selected portions of the blank 12.

Preferably, and as shown, a suitable brake 163 which is pivotally mounted on the bar 152 is positioned relative to a side wall blank 12 passing thereunder to prevent the blank 12 from moving backward when it is being picked up by the using machines. Such brakes are known in the art and need not be further described herein. Also, the first conveying means is provided with hold-down apparatus which will prevent a blank 12 from moving out of frictional engagement with the belts 142. This is best seen in FIGS. 11 and 12. As friction means 127 first moves a sidewall blank 12 forward, it engages belts 142 between the lower surface of rollers 162 and the upper surface of belt 142. Rollers 162 are preferably biased downward such as by a spring (not shown) inside tubes 164 supported by bracket 169 attached to the top of arms 117. A weighted pivot arm 165 is pivotally mounted on each of the arms 116 and 117 and preferably has a roller 166 on the end thereof whereby the weight of the arms 165 and roller 166 retain the side wall blank in frictional engagement with the belts 142. As sidewall blank 12 moves forward to the end of belts 142, it is guided between bars 152 and 153 by fixed rollers 173 attached to bar 152. As best seen in FIG. 14, one or more idler pulleys can be mounted on the support 105 to help adjust slack out of the chain 136. Idlers 167 are each rotatably mounted on a respective arm 168 which in turn is secured to a portion of the support 105 in a manner so that same can be easily adjusted.

The feeding means 102 is provided with means for selectively allowing feed or no feed operation. In the illustrated structure, as best seen in FIGS. 11 and 13, this means includes an arm 170 pivotally mounted on the shaft 123. The arm has a portion 171 with a roller 172 mounted thereon which is selectively engageable with the top blank 12 on the stack 108. The arm has a second portion 174 which in turn is connected to an extendable and retractable ram 175 which selectively effects pivoting movement of the arm 170 on the shaft 123. The ram 175 preferably is mounted on the support 105 as, for example, a clevis mount 176 pivotally secured to a bracket 177. The rod portion of the ram 175 is then pivotally connected to the portion 174. Extension of the ram moves the arm 171 downwardly and the roller 172 into engagement with the top blank thereby elevating shaft 123 and the first and second arm means 109 and 110 so that the friction member 127 is out of feed engagement with the top blank 12 of the stack 108. Retraction of the ram 175 moves the roller 172 out of engagement with the top blank 12 thereby allowing feeding engagement between the friction member 127 and a blank 12. By regulating the pressure on the retraction side of the ram 175, a force adjustment can be accomplished to adjust the force applied to the top blank 12 by the friction member 127.

In a preferred embodiment of the present invention the storage magazine 103 is as described below. The magazine 103 includes a framework 185 which includes cross braces 186, 187, 188 and 189 and a plurality of upstanding supports 190. The framework 185 can be made of any suitable material such as structural angles. Plates 191, 192, and 193 can be secured to the braces 186, 188, and 189, respectively. A pair of wall forming members 194 and 195 are secured in the framework 185 in a suitable manner and, as shown, extend between the plates 191 and 192 and are suitably secured thereto. The walls 194 and 195 are spaced apart and positioned relative to one another to receive a stack 108 of blanks 12 therein and form a generally vertically positioned stack wherein the walls 194 and 195 prevent lateral movement of the blanks. Preferably, a portion 196 of the wall 194 is in hinged relation to the remainder of the wall 194 so that same can be moved between open and closed positions to facilitate loading of blanks. A suitable lock 198 selectively prevents movement of the portion 196 about the hinge 197.

The storage magazine 103 includes two elevator means 200 and 201 which are in generally vertical alignment relative to one another with the elevator 200 being a lower elevator and the elevator 201 being an upper disposed elevator. The elevator means 200 and 201 cooperate with one another in a manner described below. Although several modes of operating cooperation can be accomplished, a preferred mode is that blanks are fed from the stack supported by the elevator means 200 until a predetermined up position is reached by the elevator 200 at which time the elevator means 201 continues to feed the blanks to the feeding means 6 while the elevator means 200 is returning to a fill position for replenishment of the supply of blanks. Upon replenishment the elevator means 200 is actuated and moves upwardly and at a predetermined up position a portion of the elevator means 201 is actuated allowing a portion of the stack carried by the elevator means 201 to join the stack of blanks carried by the elevator 200 at which point the elevator 200 continues upward movement for feeding of blanks to the feeding means 102. This will cause a minimum of missed feeds thereby still resulting in an efficient feeding means 102.

In the illustrated structure the elevator means 200 includes a platform 202 which is movably mounted in the framework 185 as, for example, by having a brace or support 203 secured thereto and means for selectively effecting reciprocating vertical movement thereof. As shown, the support 203 is movably mounted on a guide or slide 204 wherein rollers 205 and 206, which are rotatably mounted on a portion of the support, engage the slide 204. The rollers 205 are spaced from the roller 206 a distance sufficient to stabilize the support 203 during movement. An opening 207 is provided in the wall member 195 and provides clearance for a portion of the support 203 extending through the opening 207 so that the support 203 and platform 202 can move therein vertically. Power means is provided to cooperate with the support 203 to effect movement thereof and, as shown, the power means includes an extendable and retractable pneumatic ram 209 which preferably is double acting and is mounted on the framework 185. The ram 209 has a rod portion 210 thereof engageable with an upstanding portion 211 of the support 203 whereby extension and retraction of the ram 209 effects vertical movement of the platform 202 and support 203 and is guided by the roller and slide arrangement. Preferably, the platform 202 is shaped similar to the shape of the blanks 12 carried thereby and as shown has a pair of opposed cutouts 212 and 213 for a purpose to be later described. The cutouts 212 and 213 are sized and positioned so that a portion of the blanks 12 extends over each of the cutouts.

The elevator means 201 is best seen in FIG. 17 and is positioned generally above the elevator means 200. In the illustrated structure the elevator means 201 includes a pair of jaws 215 and 216 mounted on a carriage 217. The jaws are shaped and positioned so as to have portions received within respective cutouts 212 and 213 and are adapted to be selectively moved from an expanded position to a retracted position, i.e., within the respective cutouts 212 and 213 so as to be under a portion of blanks carried by the platform 202. In the illustrated structure the carriage 217 has the jaws 215 and 216 pivotally mounted thereon as by pivots 219 and 220, respectively. Any suitable type of pivot can be used. The means for moving the jaws 215 and 216 between the expanded and retracted positions is best seen in FIG. 15 and is shown partially in broken lines as same is hidden behind a portion of the carriage 217. The jaws 215 and 216 each have an arm portion 221 and 222, respectively. Links 223 and 224 are pivotally connected to the respective arms 221 and 222 in any suitable manner with each of the links having an end portion thereof pivotally connected to each other as at 225. Power means is provided to effect operation of the jaws 215 and 216 and, as shown, a pneumatic ram 226 is carried or mounted on a portion of the carriage 217 as by a bracket 227 with the ram having the movable rod portion 228 thereof pivotally connected to the links 223 and 224 at the pivot 225 as by a clevis 229. Retraction of the ram 226 will effect expansion of the jaws 215 and 216 and extension of the ram 226 will effect retraction of the jaws 215 and 216 to the position as shown in FIG. 15. The jaws 215 and 216 form a platform on which a stack of blanks 12 can be supported for upward movement to the feed means 102.

Means is provided to effect vertical reciprocal movement of the elevator means 201 in general axial alignment with movement of the elevator means 200. It is to be understood that any suitable means can be employed. In a preferred embodiment power means is provided to effect the reciprocating movement of the elevator means 201 and preferably the power means is a selectively extendable and retractable pneumatic ram 231 which is secured to the framework 185. The movable rod portion 232 of the ram 231 is secured to the carriage 217 whereby extension and retraction of the ram will vertically move the elevator means 201 downwardly and upwardly, respectively. In order to guide the movement of the elevator means 201 suitable guide means is provided to cooperate with the carriage 217. As shown, the guide means include a pair of rollers 233 secured to each side plate 234 of the carriage 217. A slide or guide member 235 is secured to the framework 185 adjacent opposite sides thereof and is in engagement with a respective pair of rollers 233 to effect the guiding.

In order to control the various movements of the components of the storage magazine 103 a control system is provided. The following control system is a preferred form, however, it is to be understood that other arrangements of components can be made and still provide an adequately operable storage magazine 103. If a different operating procedure is desired, minor variations can be made in the below-described control system to accomplish the different operations. The control system described below operates the storage magazine 103 in the following manner with the elevator means 201 being empty and the apparatus 6 ready for operation. A stack of blanks 12 is loaded onto the platform 202 when same is in the down position as seen in FIG. 16. The elevator means 200 is actuated wherein the stack thereon moves upwardly and when the top blank reaches a position suitable for engagement with the friction member 127 feeding of blanks commences. At a predetermined position of the platform 202, the jaws 215 and 216 move to a closed or retracted position, as seen in FIG. 15, whereby the elevator means 201 continues to move the stack upwardly so that blanks can be fed therefrom by the feeding means 102. The elevator means 200 can then be lowered for refilling. After same reaches the bottom a new stack of blanks can be loaded on the platform 202 after which platform 202 can be actuated to move upwardly and at a predetermined position the jaws 215 and 216 will be actuated and move to an extended position whereby the stack remaining thereon will join the top of the stack resting on the platform 202 whereby the platform 202 continues upward movement for maintaining a blank in a feeding position adjacent the friction member 127. The abovedescribed process will be repeated when the platform 202 reaches a predetermined up position as described above.

The control system for the elevator means 200 and 201 preferably is comprised of pneumatic controls for activating the various component parts in the proper sequence. In the illustrated control system, a main supply line 241 is connected to a suitable source of pressurized air 241'. A plurality of branch lines 242, 243, 244, 245, 246, 247 and 248 are all connected to the line 241 and are adapted for providing pressurized air to various portions of the control system. All component parts of the control system of FIG. 19 are shown schematically in their normally unactuated mode and broken lines indicate pilot air lines. The locations of the control components are best seen in FIGS. 15 and 16. In the description of the control system the parts and their various functions will be described simultaneously for purposes of clarity. When pressurized air is supplied to the line 241 and the branch lines pressurized air is supplied to a four-way valve 249 through the line 244. A line 250 is connected to one port of the valve 249 and there is also connected to the line 250 a line 251 which in turn connects the line 250 to the pilot of a valve 252 which is a four-way valve. When pressurized air is supplied to the valve 252 from the line 251 this pilot actuated valve will shift allowing air to flow from the pressure line 243 through the valve into the line 253, that is connected to valve 252, and then to the ram 226. A line 254 connects the other side of the ram 226 to another port of the valve 252. When the valve is in the shifted position, the line 254 acts as a vent line for venting of air from one side of the ram through the valve 252. This would effect extension of the ram 226. Shifting of the valve 252 in the opposite direction would reverse operation of the ram 226 wherein venting would be accomplished through the line 253 and the valve 252. Extension of the ram 226 will effect movement of the jaws 215 and 216 to their retracted or closed position for supporting a stack of side walls. Pressurized air in the line 250 is also supplied to a line 258 which is connected thereto and to the pulse valve 259, the line 260, a shuttle valve 261 which will then provide pilot air through a line 262 to the pilot of a pilot-operated four-way valve 263 which will shift under the influence of the pilot air. The pulse valve 259 is for the purpose of momentarily shifting valve 263. When the valve 263 shifts, air supplied from the line 246 to the lines 264, 265 and 266 for pilot operators. The lines 265 and 266 are connected to pilots of pilot-operated two-way valves 267 and 268, respectively. The valves 267 and 268 are normally closed whereby when air is supplied through the lines 265 and 266 same move to an open position so that the ram 209 can return to its lower or retracted position. When the ram 209 moves to its retracted position, the bottom portion of the support 203 (see FIG. 16) contacts an actuating lever of a three-way valve 272 to move the valve 272 to an open position whereby pressurized air can be supplied from the line 247 through the valve 272 to a line 273 and also a line 274 which is connected to normally open pressure switch 275 which can be operably connected to a light or alarm for activation of same to tell an operator that the lower elevator 200 has the platform 202 in a position ready for filling or reloading. The line 271 is also connected to the line 273 for supplying air to a shuttle valve 270 which is connected to the valve 263 to return it to its original position.

A four-way valve 276 is connected in the line 245 and has a line 277 connected to one port of the valve 276 and a port of the four-way valve 278. A line 279 is connected to the valve 278 and has lines 280 and 281 connected thereto with the line 281 being connected to the valve 267 and the line 280 being connected to a normally closed two-way valve 282. Lines 284 and 285 are also connected to the valve 278 via a line 286. The lines 284 and 285 are also connected to valves 283 and 268, respectively, when the valves 283 and 268 preferably being two-way normally closed pilot-operated valves. Pressurized air flows through the valves 282 and 267 as supplied from the valve 278 which in turn is supplied from the valve 276 in the line 245. At this time, valves 283 and 268 are vented through the lines 284, 285 and 286 whereby with pressurized air being supplied to the normally closed valves 282 and 267 the ram 209 is urged into its retracted position and the ram 231 is urged to its extended position whereby both of the elevator means 200 and 201 are in their lower position.

Three-way valve 287 is moved to a open position if the first and second arms means 109 and 110 are in position for feeding side walls. If so, pilot air is fed through the valve 287, the line 288, a four-way valve 289 and a line 290 providing pilot air to shift three-way valve 291 to an open position thereby providing pilot air from line 250 through the valve 291 through line 292, shuttle valve 293 into lines 294, 295 and 296 to thereby move valves 283 and 282 to an open position. Since valve 282 is on the pressure side of the ram 231, and the valve 283 is in a vent position on the vent side of the ram 231, the ram 231 begins to retract with its feed being controlled by a throttle valve 298 which is connected in a line 308 between the ram 231 and valve 283. Retraction of the ram 231 positions side walls for feeding by moving same into engagement with the friction member 127.

As soon as the bottom elevator platform 202 has been reloaded by the operator, the valve 272 being closed by engagement with the platform 202 when same is in the down position, the operator can manually depress a three-way push-button balve 299 to initiate a quick lift by supplying pilot air through a line 300 to a pilot of a four-way valve 301. Pilot air shifts the valve so that pressurized air supplied from the line 248 through the valve 301 into a line 302 through a check valve 303 and into a line 304 which is connected one side of the ram 209. The line 304 also connects the valve 268 to the ram 209. This starts the lift of the platform 202 and air is vented from the other side of the ram 209 via a line 305 which is connected to a line 311 which is connected to the ram 209. The line 305 is also connected to the valve 301, so that when same is shifted for lifting of the ram 209, venting of the opposite side of the ram 209 can be accomplished through the valve 301 permitting full speed movement of the ram 209 to an extended position. When the top of the stack of side walls contained on the lower platform 202 reaches and depresses a lever arm of the valve 249, the valve 249 preferably being mounted on the jaw member 216, the valve is shifted to provide pilot air through the lines 306 and 307, the shuttle valve 293 and lines 294, 295, and 296 to open the valves 283 and 282 allowing the valve 282 to vent the ram 231 via line 309 which connects the valve 282 to one side of the ram 231. The line 308 connects the valve 283 to the ram 231 through the valve 298 and pressurized air is supplied through the valve 278 to the valve 283 which are open with the valve 278 being shifted by pilot air supplied through the line 307. This allows pressurized air to flow into one side of the ram 231 to effect extension thereof which effects downward movement of the upper elevator means 201. Since the valve 252 is a spring return valve, the shift of the valve 249 as described above allows pilot air to flow into lines 250 and 251 wherein the valve 252 is shifted so that pressurized air is supplied to the ram 226 so same is retracted and thereby move the jaws 215 and 216 to their open position whereby the stack of side walls which were supported thereby move downwardly and join the stack of side walls carried by the lower elevator means 200.

A pilot line 310 is connected to the line 306 and also a pilot connection of the valve 301. When pilot air is supplied through the lines 306 and 310, when the valve 249 is shifted, the valve 301 is reshifted to the position shown so that the air contained in the rod side of the ram 209 cannot be vented through the line 305 but vents through the line 311 and an ajustable throttle valve 312 connected in the line 311. The air is also vented from the line 311 through the valve 267 and the valve 278 which has shifted due to pilot air being supplied from lines 306 and 307. This allows control of the upward movement speed of the ram 209. While this upward movement is taking place, the ram 231 automatically moves to a wait position, i.e., a fully extended position. As the combined stack of side walls moves upward via extension of the ram 209, the limit valve 287 is closed thereby providing pilot air through the line 288, the valve 289 and the line 290 to a four-way valve 314 wherein the pilot air shifts the valve 314. A line 313 connects the valve 314 to the pilot line 310 and when the valve 314 is shifted, pilot air from the line 313 is supplied therethrough via a line 316 to the shuttle valve 270 to effect shifting of the valve 263 which in turn provides pilot air through the line 264 to the lines 265 and 266 and thereby shift the valves 267 and 268 to their open positions. This will effect upward movement of the lower elevator means 209 in response to the signal generated by the feeding means actuating the valve 287 when the stack becomes too low for feeding whereby the ram 209 moves upwardly to move the stack of blanks into a feeding position. As the elevator means 200 moves upwardly, the bottom of the stack of side walls moves past an actuating lever arm of the valve 249 allowing the lever to move outward thereby shifting the valve 249 so as to provide pilot air via the lines 250 and 251 to shift the valve 252 so as to provide pressurized air from the line 243 through the line 253 so as to extend the ram 226 and move the jaws 215 and 216 inwardly and under the stack of blanks and into the cutouts 212 and 213. When this is accomplished the ram 231 has the valves controlling same shifted as described above so that same is in an operating mode for retraction thereby raising the upper elevator means 201 to move the stack of blanks supported by the jaws 215 and 216 upwardly for feeding. Also, as described above, when the ram 31 begins to retract the ram 209 is placed in an operational mode for retraction thereby lowering the lower elevator means 200. When same reaches the down position the valve 272 is moved to an open position and sets off the alarm as controlled by the valve 275 as described above signaling that the lower elevator means 200 needs reloading.

The valve 276 and the valve 287 are activated or operated by movement of the arm means 109 and 110 wherein the link 121 connecting same, as shown, has an abutment member 321 secured thereto whereby if the upper and/or lower elevator means moves too far upwardly, the lever arm of the valve 276 will be contacted momentarily shifting valve 276 to provide pilot air through a line 322 through the valve 314, line 313 and thereby shift the valve 301 to thereby effect lowering of the lower elevator if it is in a lift operating mode. Operation of the valve also supplies pilot air through the line 322 to the line 323 through the shuttle valve 261, the line 262 in order to shift valve 263 so as to effect movement of the valves 267 and 268 to their open positions so that the valve 268 is open to vent causing the elevator to move downward in a short pulse. If the upper elevator means 201 is the one moving the stack of blanks rather than the ram 209, the valve 282 is vented momentarily through the valve 278, the line 277 and the valve 276 thereby allowing the ram 231 to momentarily move downwardly in a pulse until the lever arm of the valve 276 is no longer contacted by the feeding means 102.

If the arm means 109 and 110 drops to a position to contact the valve 287 in which event the stack of blanks is too low for a proper feeding, valve 287 is shifted to an open position thereby allowing pilot air to flow through the valve 289 to the valves 291 and 314 to shift same to their original position momentarily. If the ram 209 is in an operational mode and pressurized air is applied through the valve 268 thereto to allow the ram 209 to be momentarily supplied with pressurized air to extend the ram 209 wherein same is raised until the valve 287 is moved to a closed position. If the ram 231 is in an operational mode, the valve 282 has pressurized air supplied therethrough to retract the ram and raise the elevator until the valve 287 is moved to its closed position. In any event, the supply of side walls during upward movement of the upper elevator diminishes until the upper elevator 201 contacts the lever arm of the valve 289 which is mounted on wall 194 wherein same is shifted to provide pilot air from line 242 through the valve 287, line 288 and into a line 325 which is connected between the valve 289 and normally closed pressure switch 326 to open an electrical circuit which is operably connected to the side wall and disc feeders of the package-forming machine to turn same off.

As described above, the blank 12 is passed through sidewall heater 7 to heat to a suitable bonding temperature the thermoplastic coating in the side marginal portions which are to be overlapped in the formation of the sidewall into a container and, if desired, in the bottom marginal portions which is to be bonded to the bottom member 4. Turret 5 preferably is mounted for rotation about its horizontal axis and is provided with a plurality of mandrels 9 which extend radially outwardly from said horizontal axis in a vertical plane perpendicular to said horizontal axis. The mandrels 9 are spaced apart on the turret 5 in a uniform manner. The turret rotates, stepwise, in a clockwise direction as viewed in FIG. 2, to move a bare mandrel from the bottom feeding station 3 to receive a bottom member 4 and then to the horizontal position in alignment with sidewall feeder 6 to receive a heated blank 12. Each mandrel 9 has a sidewall clamp 8 associated therewith which is in the open position, spaced apart from its mandrel 9, at the sidewall blank receiving station to permit the heated blank 12 to be inserted between the mandrel 9 and clamp 8 by feeder 6. The clamp 8 is then actuated to secure the median or intermediate portion of the heated blank 12 in position on mandrel 9, after which the turret 5 is indexed to the next position to carry the secured blank 12 and bottom member 4 to the sidewall wrapper 11. The sidewall wrapping means 11 wraps the blank 12 around mandrel 9 to form a convolute and to apply pressure to the overlapped heated side margins to bond the side margins, thereby forming a tubular sidewall 10.

At the next indexing of turret 5, the mandrel carrying the tubular sidewall 10 is moved from the sidewall wrapper 11 to the bottom heater 13, where the margin of the sidewall adjacent the bottom member 4 is heated by bottom heater 15 to a suitable bonding temperature. The turret 5 is then indexed to transport the mandrel 9 and the heated sidewall 10 to a bottom sealing station, where bottom forming or sealing means 14 applies pressure to the heated portions of the sidewall 10 and bottom member 4 to form the bottom seal after which same can be crimped by the bottom crimper 15.

After the bottom seal is formed, the turret 5 is indexed to transport the formed container 2 to a stripping station, and the associated clamp 8 is moved to the open position to release the container 2. Although any suitable mechanical stripping means can be employed, it is presently preferable to utilize pneumatic pressure applied through the mandrel to the inside of the container to eject the container from the mandrel 9 into the receptacle 17. Turret 16 is rotated stepwise about its horizontal axis to move the ejected container 2 from its initial position to a bead former 18 as described below.

Spring biased wiping blades 435 and 436, carried by folding wing 437 and 438, respectively, contact the outer surface of sidewall blank 12 on opposite sides of the respective clamp 8 when mandrel 9 is indexed into the sidewall wrapping station. The folding wings 437 and 438 are then actuated to rotate about the longitudinal axis of the mandrel 9 in opposite directions at an at least substantially constant distance from the longitudinal axis of the mandrel 9 to wrap the sidewall blank 12 around mandrel 9 with one side margin of blank 12 overlapping the opposite side margin of blank 12 to form the convolute container sidewall 10. The leading edge of blade 435 can be rotated in advance of the leading edge of blade 436 by a few degrees so that blade 435 causes the left edge portion of sidewall blank 12 to fold against mandrel 9 before blade 436 folds the right edge portion of blank 12, thereby causing the right edge portion of blank 12 to overlap the left edge portion thereof. When the rotation of blades 435 and 436 is completed, sealing head 439 is actuated by piston 440 of pneumatic cylinder 441 to press the heated right edge portion of blank 12 against the heated left edge portion thereof to achieve a thermal bonding of the thermoplastic coatings and thereby form the convoluted container sidewall 10. For sake of simplicity the cylinder 441 is shown perpendicular to sealing head 439 and directly connected thereto. However, in a presently preferred embodiment the cylinder 441 is mounted on the frame in a stationary position approximately parallel to sealing head 439 when head 439 is in the sealing position. A pivoted rocker arm mechanism, which is mounted on folding wing 438 and operates sealing head 439 via a spring biased plunger, rotates into position to be operated by the piston 440 of cylinder 441, thereby translating the motion of the piston 440 of cylinder 441 approximately 90° to move the sealing head 439 against the overlapped side margins of blank 12.

Referring now to FIGS. 20–24, the actuation mechanism of sidewall wrapping means 11 comprises a carriage 442 which is mounted for forward and retractive motion by sleeve bearings 443 and 444 on guide rods 445 and 446 secured to housing 447. The motion of carriage 442 is effected by coupling 448 which is actuated by oscillating shaft 449, yoke 450, connecting linkage 451 and yoke 452. Shaft 449 can be oscillated by a rotary cam in the indexing mechanism (not shown) for turret 5). Carriage 442 has a first opening 453 therethrough extending in the direction of the reciprocating motion of carriage 442. A shaft 454 is positioned in opening 453 so as to be coaxial with and axially spaced from the mandrel 9 which is in the sidewall blank wrapping station of turret 5. Opening 453 is sufficiently large in both the longitudinal and transverse directions to prevent interference between carriage 442 and shaft 454. A sleeve shaft 455 is mounted coaxially with and surrounding an intermediate portion of shaft 454 by means of bushings 456 and 457. The upper end of shaft 454 is mounted in bushing 458 in a cross bar 459 which extends between opposite sides of housing 447. A bushing 461 is positioned between sleeve 455 and cylindrical support wall 462 which is welded to cross bar 463 which extends between opposite sides of housing 447. Wrapping wing 437 is connected to the lower end of shaft 454 by arm clamp 464, while wrapping wing 438 is connected to the lower end of sleeve shaft 455 by arm clamp 465. Arm clamps 464 and 465 are provided with suitable means, not shown, for fixed engagement with shaft 454 and sleeve 455, respectively, such that the rotation of shaft 454 and sleeve 455 effects the corresponding rotation of arm clamps 464 and 465. Suitable engaging means includes keys in keyways and set screws.

Carriage 442 is provided with linear slots 468 and 467, which extend along a straight line perpendicular to the direction of reciprocating motion of carriage 442. One end of lever arm 468 is secured to about shaft 454 for rotation therewith, while a slide means, e.g., roller 469, is positioned in slot 466 and is pivotably attached to the other end of lever arm 468 by shaft 471. One end of lever arm 472 is secured about sleeve 455 for rotation therewith while a slide means, e.g., roller 473, is positioned in slot 467 and is pivotably attached to the other end of lever 472 by shaft 474. A thrust bearing 475 is positioned about shaft 454 between lever 468 and bar 459, while a thrust bearing 476 is positioned about shaft 454 between lever 468 and carriage 442. A thrust washer 477 is positioned about shaft 454 between carriage 442 and sleeve 455, while a thrust washer 478 is positioned about sleeve 455 between lever 472 and support wall 462.

Referring now to FIG. 24, wiping blade 436 is resiliently biased in the frame of right folding wing 438 by spring means 481, while wiping blade 435 is resiliently biased in the frame of left folding wing 437 by spring means 482. While blades 435 and 436 can be formed of any suitable material which will not damage the surface of the blank 12, e.g., nylon. In a presently preferred embodiment, blade 483 is a $\frac{1}{8}$-inch thick flat bar nylon element having the blank contacting surface curved in the form of a semicircle having a 1/16-inch radius and mounted on a steel backup bar 484, while blade 435 has a nylon element 485 having a generally L-shaped configuration mounted on a steel backup bar 486, each leg having a thickness of approximately $\frac{1}{8}$-inch. The long leg of blade element 485 is at least substantially radial to the axis of mandrel 9 while the short leg extends approximately $\frac{1}{8}$-inch beyond the long leg in the direction of movement of blade element 485 during the wrapping operation. Thus the leg of blade element 485 contacting the blank 12 has a total length of approximately $\frac{1}{4}$-inch in this particular embodiment. Also in this particular embodiment the blade element 483 is mounted along the mid-line of folding wing 438 while the blade element 485 is mounted in folding wing 437 offset toward the leading side of folding wing 437, and the folding wings 437 and 438 are mounted such that the angle between the clamp 8 and the trailing edge of blade element 485 is at least equal to, if not slightly greater than, the angle between the clamp 8 and the mid-line of blade element 483, such that the leading edge of L-shaped blade element 485 is several degrees in advance of the leading edge of blade element 483, to thereby cause the side margin of blank 12 contacted by blade element 485 to fold inwardly under the opposite side margin of blank 12 contacted by blade element 483. The leading edge of blade element 485 extends forwardly of the adjacent leading edge of folding wing 437 to provide for clearance between folding wing 437 and sealing head 439 at the conclusion of the wrapping motion.

After the completion of the sealing operation, the indexing mechanism for turret 5 causes turret 5 to move the mandrel 9 carrying the newly formed sidewall 10 out of the sidewall wrapping station toward the bottom heating station and the mandrel 9 carrying the newly fed blank 12 to move out of the sidewall blank receiving station toward the sidewall blank wrapping station. Upon the commencement of the movement of the mandrel 9 carrying the sidewall 10, oscillating shaft 499 is activated to cause wrapping wings 437 and 438 to retract from the wrapped or closed position, shown in FIG. 24, to the open position, thereby permitting the mandrel 9 carrying the newly fed blank 12 to enter the sidewall blank wrapping station.

While slots 466 and 467 have been shown in the plate element of carriage 442, the carriage 442 can be provided with any suitable means defining the first and second slots 466 and 467, preferably a rigidly fixed part of the carriage 442. While slots 466 and 467 have been illustrated in the presently preferred position of extending along a single straight line perpendicular to the direction of reciprocating motion of carriage 442, the slots 446 and 467 can be positioned along separate lines which intersect the direction of reciprocating motion at angles other than 90°. However, it is still desirable that the slots be positioned such that the slide elements have a component of travel perpendicular to the direction of reciprocating motion. If desired, for ease in manufacture, slots 466 and 467 can intersect opening 453 or be in the form of a single slot when opening 453 is not employed or does not intersect the slots. The alignment of slots 466 and 467 along a single straight line perpendicular to the direction of reciprocating motion is particularly advantageous in the machining of the slots in plate 442. While the slide elements 469 and 473 have been illustrated as rollers, any other suitable slide element could be employed. The width of the slide elements is preferably just sufficiently less than the width of the corresponding slot to permit freedom of movement of the slide element along the length of the slot, while avoiding any significant play of the slide element in a direction transverse to the slot. In a presently preferred embodiment the clearance between the slide elements and the adjacent walls of the slot is approximately 0.002 inch. The movement of the wrapping wings under the sole control of the slide members provides for the relatively smooth operation of the wrapping wings in contacting the blank 12 and wrapping the blank about the mandrel 9 as compared to the slapping of the clam shell mechanisms. While the shaft 454 has been illustrated as extending through opening 453 in carriage 442 for compactness and minimum length of lever arms 468 and 472, it is possible for shaft 454 to be positioned outside of carriage 442 by employing longer lever arms 468 and 472. While sleeve bearing 443 has been illustrated on the underside of plate 442 to provide clearance for lever arm 468, both sleeve bearings 443 and 444 can be mounted on the same side of plate 442 where clearance is not a problem.

Now referring to FIGS. 1 and 25 through 29, the rim forming means 18 includes at least one container receiving receptacle 17 which has a container receiving pocket 525 therein with the receptacle having a free end surface 526 which are best shown by referring to FIG. 25. The pocket is sized and shaped to suitably receive therein a partially formed container 2 which while retained within the pocket 525 has the bead or rim 19 formed on the free end thereof. The end surface 526 forms a mating surface for a purpose to be later described. A tapered lead-in surface 528 extends between the mating surface 526 and the surface defining the pocket 525 and provides a lead-in to facilitate entry of the to be completed container 2 into the pocket 525.

In a preferred embodiment, the receptacle 17 is mounted on a conveying means, however, it is to be understood that means for conveying the receptacle are not necessary as a container 2 can be transported to a stationary receptacle in which the bead can be formed. However, it is preferred that the receptacle be movable by conveying means so as to facilitate high speed production of containers. Any suitable type of conveying means can be used and as illustrated the conveying means includes a rotatable turret 16 which is mounted on the apparatus 1 and preferably has an axis of rotation parallel to the axis of rotation of the turret 5. Drive means (not shown) are operably associated with the turret 16 to effect rotation thereof preferably in a sequential manner whereby and as illustrated the turret 16 has a plurality of receptacles 17 mounted thereon whereby each receptacle can be moved to a desired position for different steps of the bead-forming operation. The drive means (not shown) are well known in the art and need not be further described herein and can include an indexing drive means such as an index unit made by Commercial Cams Co. of Chicago, Ill., a division of Emerson Electric Co. As best seen in FIG. 1, the turret 16 is rotatably mounted adjacent the turret 5 whereby a partially finished container 2 is ejected from a mandrel 9 after same is completed and into a waiting receptacle 17 such as by using air to eject the container 2. After receiving a container in the receptacle, the turret 16 can then move one step at a time until the container blank is moved to the rim forming means after which the container having the rolled rim thereon can be ejected from the receptacle 17 such as by the use of pressurized air introduced into the receptacle 524 through ports 527.

Forming means 18 is provided for the apparatus 1 to form the rolled rim or bead 19 on the open end of the container blank 2. The forming means 18 includes a ring member 533 suitably movably mounted on a respective receptacle 17 and having a surface 534 which is a mating surface with the surface 526. Any suitable mounting means can be provided and as shown guide members 535 are secured to one of the ring 533 or receptacle 17 and is movable in the other of the ring 533 or receptacle 17 so as to allow relative movement therebetween and provide guides to facilitate the movement. As shown, the guides are threaded bolt-type members which are threadably engaged in threaded bores 536 in the receptacle 17 and have bearing portions 537 slidably received through guide bores 538 through a portion of the ring 533. A counter sink 539 is coextensive with a respective bore 538 and provides a recess for a head portion of the guide 535 to be received therein wherein the head portion 540 also acts as a stop to limit movement of the ring 533.

The ring 533 has a through bore 542 which is coaxial with the axis of the pocket 525 with the bore 542 preferably having a size slightly larger than the size of the open end of the pocket 524 and preferably a size so as to form a continuous surface with the tapered surface 528 so as to form a smooth lead-in for the closed end of the container blank 2. This is best seen in FIG. 25. Also, the ring 533 has an upper surface 543 which is generally parallel to the surface 534 and faces away from the pocket 525. Positioned radially outwardly from the surface defining the bore 542 there is an annular groove portion 544 recessed within the surface 543 for forming the rim 19. Preferably, the surfaces 543 and 534 are generally normal to the axis of the bore 542 and axis of the pocket 525.

The ring 533 is movable between an extended position as seen in FIG. 25 and a retracted position as best seen in FIG. 27 wherein the surfaces 534 and 526 are in engagement with one another to limit the movement of the ring 533. Preferably, the ring 533 is biased to its extended position by resilient means which in the illustrated structure include a plurality of resilient members 545 such as coil springs which are positioned between the ring 533 and the receptacle 17 and are preferably received within pockets 546 and 547 which are in the ring 533 and receptacle 17, respectively, and are recessed in the surfaces 534 and 526, respectively.

The forming means further includes a forming head 550 which is mounted on drive means 551, best shown in FIG. 1, to effect rotation of the forming head 550 and also movement of same between an extended and retracted position as more fully described hereinbelow. The forming head 550 has a surface 552 with a bead forming groove portion 553 recessed therein which cooperates with the groove portion 544 to form a substantially enclosed bead forming groove as best seen in FIGS. 26 and 27. By substantially enclosed, it is meant that there is an opening 554 which communicates with the groove portions 544 and 553 when the forming head is adjacent the ring 533 so as to allow the wall of the container 2 to enter the groove. As used herein, the extended position of the forming head 550 is that in which it is adjacent the ring 533. However, it is to be noted that the forming head is adjacent the ring 533 throughout the distance which the ring 533 moves from its extended position to its retracted position which is included in the extended position of the forming head 550. This can best be seen by referring to FIGS. 26 and 27. To reduce friction between the forming head 550 and the ring 533 during rotation of the forming head 550, bearing means is provided and in the illustrated structure the bearing means include a plurality of rollers 556 which are rotatably mounted on the forming head as, for example, by being rotatably mounted on axles which are secured to the forming head in any suitable manner such as by threaded engagement as at 558. The rollers 556 are positioned such that they will engage the surface 543 before the surface 552 and 543 can engage. An annular rib 559 projects from the surface 552 and is positioned radially inwardly from the groove 553 and is sized on its outer diameter to be received within the bore 542. The rib 559 has an outer surface 560 which is spaced from the surface defining the bore 542 a sufficient distance to allow the passage of the container wall therebetween so as to provide access to the groove formed by the groove portions 544 and 553. Preferably, the surface 560 is tapered or inclined away from the groove 553 and the surface defining the bore 542 so as to provide a lead-in for the wall of the container blank 2.

To reduce wear of the forming head 550, particularly in the groove 553, wear reducing members 561 are mounted in the forming head 550 with each of the members 561 having a notch 562 which corresponds in shape to the groove 553 and preferably is slightly above flush so that the container wall will contact the surface defining the notches 562 thereby reducing contact between the container blank 2 and the groove surface so as to reduce friction therebetween. This facilitates maintenance of the forming head 550 whereby inexpensive wear members 561 can be replaced instead of the entire forming head. The members 561 are held in position in any suitable manner as, for example, by having a set screw 563 in threaded engagement with the forming head 550 as in a threaded bore 564 which is in communication with a member receiving bore 565 whereby the set screw upon tightening will hold the member 561 in a removable manner within the respective bores 565. A plurality of the members 561 are positioned at various positions along the groove 553.

The drive means 551 can be of any suitable type and, as shown, has a shaft 570 which is rotatable by a power means such as an electric motor 551' (shown in FIG. 1) and can be driven as, for example, by a belt 571 and pulley 572 arrangement. This provides rotational movement of the forming head 550. The shaft 570 is mounted in bearings 573 which provide not only for rotational movement but also axial movement of the shaft 570. The shaft 570 is suitably moved axially by means 574 which includes an arm 575 that moves a member 576 which is mounted on the shaft 570. The arm 575 is operably connected to means such as a shaft 577 receptacle rotated from the main drive of the machine to effect the movement of same and the member 576. Means for effecting rotational and axial movement of a shaft are well known in the art and it is to be understood that any suitable type of this means can be used.

Means 580 is provided to releasably retain the rings 533 in a retracted position. As shown, the means 580 is latch means with each of the receptacles having, in the illustrated structure, a latch member 581 mounted thereon which cooperates with a respective ring 533 to releasably retain same in the retracted position. As shown, each of the rings 533 has a suitable abutment 582 thereon and in the illustrated structure a groove 583 is in an exterior surface 584 of the respective ring 533 wherein the abutment 582 is a surface of the groove 583. The latch 581 has an abutment 586 which is formed by one of the surfaces defining a notch 587 in one end of the latch 581. The abutments 582 and 586 engage one another to releasably retain the ring in its retracted position. As shown, the latch 581 is pivotally mounted on the respective receptacle as, for example, by a pivot arrangement 588 which is suitably secured to the receptacle 17. Preferably, resilient means such as a spring 590 biases the latch 581 to its latching position as best seen in FIG. 27. As shown, the spring 590 is received within a pocket 591 recessed in the receptacle 17. The spring then engages the latch 581 and by virtue of compression in the spring 590 biases the latch 5to its latching position. Referring to FIG. 29, means is provided to release the latch 581 from its latching position and, as shown, the means includes a trip cam member 593 which is secured to a portion of the apparatus 1 and is positioned adjacent to the turret 16 and during sequential movement of the turret 16, the respective latch 581 moves by the trip 593 and by virtue of same having an inclined surface 594 the latch 581 is induced to pivot as same moves by the trip 593 and thereby the latch 581 moves out of latching engagement with the ring 533. This release is just before the receptacle reaches the forming head 550. When unlatched, the ring 533 under the bias of the springs 545 moves to its extended position and is ready for forming a bead in cooperation with the forming head 550 and upon movement of the forming head 550 to its extended position, the ring 533 is thereby moved to its retracted position during formation of the bead 19 and the latch 581 reengages the ring 533 to retain same in its retracted position.

When the ring 533 is in its extended position the grooves 544 and 553 are complementary to aid the formation of a uniform smooth shaped bead 19 and in its retracted position, the ring 533 reduces the friction on the side of the container to permit its ejection as hereinafter described.

In a preferred embodiment, a lubricating means 600 as shown in FIG. 28, is provided and is operable to lubricate the upper edge of the container 2 before same has the bead formed thereon. This lubrication is desirable to facilitate formation of the bead 19. Such lubricators are known in the art and, as shown, the lubricator is positioned above the receptacle 17 at a location ahead of the forming head 550 so that in the dispensing position as shown, the outlet 603 touches the edge of the container blank 2. The lubrication means 600 is supported on the arm 601 attached to the frame of the machine, a bracket 602 has a reservoir 604 at its upper end with its outlet 605 communicating with the bore 606 in the bracket 602, the bore 602 has a piston 607 therein attached to the piston rod 610 of a pneumatic cylinder 609. The piston 607 has a through bore 608 that in the extended position of piston 607 communicates with the outlet 605 to receive lubricant from reservoir 604 and in the retracted position dispenses lubricant to the edge of container blank 2. The pneumatic cylinder 609 is activated by means (not shown) at each indexing movement of turret 16. Reservoir 604 can alternately be a conduit supplying lubricant from a remote source.

It is to be understood that while we have illustrated and described certain forms of our invention, it is not to be limited to the specific form and arrangement of parts as herein described and shown, except to the extent that such limitations are found in the claims.

What is claimed and desired to be secured by Letters Patent is:

1. An apparatus for forming a container having a side wall and a bottom closure member, said apparatus including:

(a) a support;

(b) conveying means mounted on said support and being operable for conveying a mandrel from one station of the apparatus to an adjacent station of the apparatus;

(c) bottom closure forming means positioned adjacent said conveying means and adapted for forming a bottom closure member and transferring same to said mandrel, said bottom closure forming means including:

(1) a forming die having a plurality of different sized forming areas;

(2) feed means cooperating with said forming die and being operable for feeding bottom blanks to said forming die;

(3) a plunger arrangement positioned adjacent said die and adapted to move a blank from said feed means into said die, said plunger arrangement having a plurality of different sized portions for cooperating with a respective forming area to form a plurality of sapced apart fold lines on said blank; and (4) fourth means connected to said plunger arrangement and operable to selectively move same into said die and retract same from said die;

(d) side wall blank feeding means positioned adjacent said conveying means and adapted for feeding a side wall blank to the mandrel carrying said bottom closure member, said side wall feeding means including:

(1) a support member;

(2) a first arm means pivotally mounted on said support member and having a free end;

(3) a second arm means pivotally mounted on said support member and spaced from said first arm means and having a free end;

(4) a first member pivotally connected to said first arm means and second arm means adjacent the respective free ends;

(5) a feed member mounted on said first arm means and movable therewith, said feed member is spaced from a portion of said first member forming a side wall blank receiving throat therebetween, said feed member being operably connected to drive means for effecting operation thereof;

(6) conveying means positioned adjacent said feed member and operable for conveying a side wall blank fed by the feed member through the throat to a point of use, said conveying means being operably connected to drive means for effecting operation thereof;

(7) a magazine for storing a plurality of side wall blanks;

(8) heating means adapted for heating side marginal portions of said side wall blank;

(e) wrapping means positioned adjacent said conveying means and adapted for wrapping a side wall blank about a mandrel carrying same and overlapping the side marginal portions thereof and holding the side overlapped marginal portions in engagement with one another for securing same together, said wrapping means including:

(1) a clamping means associated with each of said mandrels to hold an intermediate portion of a blank therebetween;

(2) first and second folding wing means each of said first and second folding wing means having a frame, a wiping blade, and means for resiliently mounting the wiping blade in the frame for movement of the blade along the line radial to the longitudinal axis of said mandrel when said a blank wrapping position; said first and second folding wing means being positioned for the wiping blades to contact the outer surface of the thus held blank on opposite sides of said clamping means;

(3) fifth means for rotating each of said first and second folding wing means about the longitudinal axis of a said mandrel in the blank wrapping position to wrap the blank about said mandrel with one side margin of said blank overlapping the opposite side margin of said blank; and (4) said fifth means comprising a carriage, guide means for supporting said carriage, means for effecting forward and retractive motion of said carriage in said guide means in a reciprocating manner, first and second shafts, said second shaft being a sleeve positioned coaxially with and about an intermediate portion of said first shaft, said carriage having means defining first and second slots therein extending at least generally transversely to said direction of the reciprocating motion, a first slide element positioned in said first slot in operative engagement therewith, means connecting said first slide element to said first shaft for smoothly rotating said first shaft responsive to movement of said first slide element transfer sleeve to said direction of the reciprocating motion, a second slide element positioned in said second slot in operative engagement therewith, and means connecting said second slide element to said second shaft for smoothly rotating said second shaft responsive to movement of said second slide element transversely to said direction of the reciprocating motion;

(f) container bottom forming means positioned adjacent said conveying means and adapted for reverse bending a portion of the side wall blank over a skirt portion of the bottom closure member and moving same into engagement with one another for securing same together;

(g) bead forming means positioned adjacent portion of said conveying means and adapted for forming a bead on an edge of a partially formed container at the open end thereof, said bead forming means including:

(1) a container receiving recaptacle having an open free end with a first surface defining the free end, said receptacle having a container receiving pocket therein extending inwardly from the open free end;

(2) a ring having a through bore communicating with said pocket, said ring also having second and third surfaces with said second surface being adjacent said first surface;

(3) first means movably mounting said ring on said receptacle wherein said ring is movable between an extended position away from said receptacle and a retracted position adjacent said receptacle with said first means also biasing said ring to the extended position, said ring having an annular first groove recessed in said third surface;

(4) latch means cooperating with said ring and operable to releasably retain said ring in its retracted position;

(5) second means cooperating with said latch means for selectively releasing same from retaining said ring in its retracted position;

(6) a forming head positioned adjacent said ring and having a fourth surface with an annular second groove therein selectively cooperating with said first groove to form a substantially enclosed bead forming groove; and (7) third means having said forming head mounted on a portion thereof, said third means being operable for rotating said forming head and for selectively moving said forming head between an extended position adjacent to and engaging said ring and a retracted position remote from said ring.

2. The apparatus as set forth in claim 1 wherein said conveying means includes:

(a) a first turret having a plurality of mandrels mounted thereon and extending therefrom in a generally radial direction with the said first turret being rotatably mounted on said support and rotatable about a generally horizontal axis; and (b) a second turret having a plurality of said receptacles mounted thereon and extending in a generally radial direction with said second turret being rotatably mounted on said support for rotation about a generally horizontal axis.

3. The apparatus as set forth in claim 2 wherein:

(a) said mandrels each have a pocket opening generally toward said plunger arrangement and die when same is adjacent the bottom closure member forming means and adapted to receive a bottom closure member therein;

(b) ejector means in said pocket operable for selectively ejecting a bottom member therefrom;

(c) said die having first and second opposite open ends with said plurality of different sized forming areas therebetween with a larger sized first forming area being adjacent said first open end and a smaller sized second forming area being adjacent said second open end; and (d) said plunger arrangement having first and second portions with the said second portion being movable independently of said first portion, said first portion being sized and shaped to be received in said first forming area and said second portion being sized and shaped to be received through said second forming area.

4. An apparatus for forming a container having a side wall and a bottom closure member, said apparatus including:

(a) a support;

(b) conveying means mounted on said support and being operable for conveying a mandrel from one station of the apparatus to an adjacent station of the apparatus;

(c) bottom closure forming means positioned adjacent said conveying means and adapted for forming a bottom closure member and transferring same to said mandrel;

(d) side wall blank feeding means positioned adjacent said conveying means and adapted for feeding a side wall blank to the mandrel carrying said bottom closure member, said side wall feeding means including:

(1) a support member;

(2) a first arm means pivotally mounted on said support member and having a free end;

(3) a second arm means pivotally mounted on said support member and spaced from said first arm means and having a free end;

(4) a first member pivotally connected to said first arm means and second arm means adjacent the respective free ends;

(5) a feed member mounted on said first arm means and movable therewith, said feed member is spaced from a portion of said first member forming a side wall blank receiving throat therebetween, said feed member being operably connected to drive means for effecting operation thereof;

(6) conveying means positioned adjacent said feed member and operable for conveying a side wall blank fed by the feed member through the throat to a point of use, said conveying means being operably connected to drive means for effecting operation thereof;

(7) a magazine for storing a plurality of side wall blanks;

(8) heating means adapted for heating side marginal portions of said side wall blank;

(e) wrapping means positioned adjacent said conveying means and adapted for wrapping a side wall blank about a mandrel carrying same and overlapping the side marginal portions thereof and holding the side overlapped marginal portions in engagement with one another for securing same together;

(f) container bottom forming means positioned adjacent said conveying means and adapted for reverse bending a portion of the side wall blank over a skirt portion of the bottom closure member and moving same into engagement with one another for securing same together;

(g) bead forming means positioned adjacent portion of said conveying means and adapted for forming a bead on an edge of a partially formed container at the open end thereof, said bead forming means including:

(1) a container receiving recaptacle having an open free end with a first surface defining the free end, said receptacle having a container receiving pocket therein extending inwardly from the open free end;

(2) a ring having a through bore communicating with said pocket, said ring also having second and third surfaces with said second surface being adjacent said first surface;

(3) first means movably mounting said ring on said receptacle wherein said ring is movable between an extended position away from said receptacle and a retracted position adjacent said receptacle with said first means also biasing said ring to the extended position, said ring having an annular first groove recessed in said third surface;

(4) latch means cooperating with said ring and operable to releasably retain said ring in its retracted position;

(5) second means cooperating with said latch means for selectively releasing same from retaining said ring in its retracted position;

(6) a forming head positioned adjacent said ring and having a fourth surface with an annular second groove therein selectively cooperating with said first groove to form a substantially inclosed bead forming groove; and (7) third means having said forming head mounted on a portion thereof, said third means being operable for rotating said forming head and for selectively moving said forming head between an extended position adjacent to and engaging said ring and a retracted position remote from said ring.

5. The apparatus as set forth in claim 4 wherein said conveying means includes:

(a) a first turret having a plurality of mandrels mounted thereon and extending therefrom in a generally radial direction with the said first turret being rotatably mounted on said support and rotatable about a generally horizontal axis; and (b) a second turret having a plurality of said receptacles mounted thereon and extending in a generally radial direction with said second turret being rotatably mounted on said support for rotation about a generally horizontal axis.

6. The apparatus as set forth in claim 5 wherein said bottom closure member forming means includes:

(a) a forming die having a plurality of different sized forming areas;

(b) feed means cooperating with said forming die and being operable for feeding bottom blanks to said forming die;

(c) a plunger arrangement positioned adjacent said die and adapted to move a blank from said feed means into said die, said plunger arrangement having a plurality of different sized portions for cooperating with a respective forming area to form a plurality of spaced apart fold lines on said blank; and (d) fourth means connected to said plunger arrangement and operable to selectively move same into said die and retract same from said die.

7. The apparatus as set forth in claim 6 wherein:

(a) said mandrels each have a pocket opening generally toward said plunger arrangement and die when same is adjacent the bottom closure member forming means and adapted to receive a bottom closure member therein;

(b) ejector means in said pocket operable for selectively ejecting a bottom member therefrom;

(c) said die having first and second opposite open ends with said plurality of different sized forming areas therebetween with a larger sized first forming area being adjacent said first open end and a smaller sized second forming area being adjacent said second open end; and (d) said plunger arrangement having first and second portions with the said second portion being movable independently of said first portion, said first portion being sized and shaped to be received in said first forming area and said second portion being sized and shaped to be received through said second forming area.

8. The apparatus as set forth in claim 5 wherein said wrapping means includes:

(a) a clamping means associated with each of said mandrels to hold an intermediate portion of a blank therebetween;

(b) first and second folding wing means each of said first and second folding wing means having a frame, a wiping blade, and means for resiliently mounting the wiping blade in the frame for movement of the blade along the line radial to the longitudinal axis of said mandrel when said mandrel is in the blank wrapping position; said first and second folding wing means being positioned for the wiping blades to contact the outer surface of the thus held blank on opposite sides of said clamping means;

(c) fifth means for rotating each of said first and second folding wing means about the longitudinal axis of a said mandrel in the blank wrapping position at an at least substantially constant distance from the longitudinal axis of said mandrel to wrap the blank about said mandrel with one side margin of said blank overlapping the opposite side margin of said blank, said fifth means comprising a carriage, guide means for supporting said carriage, means for effecting forward and retractive motion of said carriage in said guide means in a reciprocating manner, first and second shafts, said second shaft being a sleeve position coaxially with and about an intermediate portion of said first shaft, said carriage having means defining first and second slots therein extending at least generally transversely to said direction of the reciprocating motion, a first slide element positioned in said first slot in operative engagement therewith, means connecting said first slide element to said first shaft for smoothly rotating said first shaft responsive to movement of said first slide element transfer sleeve to said direction of the reciprocating motion, a second slide element positioned in said second slot in operative engagement therewith, and means connecting said second slide element to said second shaft for smoothly rotating said second shaft responsive to movement of said second slide element transversely to said direction of the reciprocating motion; and (d) sixth means for sealing the thus overlapped side margins to thereby form a convoluted tubular side wall.

* * * * *